US008579306B2

(12) United States Patent
Lewis

(10) Patent No.: US 8,579,306 B2
(45) Date of Patent: Nov. 12, 2013

(54) IN-LINE OFF-ROAD SKATEBOARD

(76) Inventor: Michael George Lewis, Celista (CA)

( * ) Notice: Subject to any disclaimer, the term of this patent is extended or adjusted under 35 U.S.C. 154(b) by 182 days.

(21) Appl. No.: 12/929,345

(22) Filed: Jan. 18, 2011

(65) Prior Publication Data

US 2011/0175310 A1 Jul. 21, 2011

Related U.S. Application Data

(60) Provisional application No. 61/336,022, filed on Jan. 15, 2010.

(51) Int. Cl.
*B62M 1/00* (2010.01)
*A63C 17/00* (2006.01)
*A63C 17/01* (2006.01)

(52) U.S. Cl.
CPC ..... *A63C 17/0046* (2013.01); *A63C 17/0093* (2013.01); *A63C 17/016* (2013.01)
USPC ..... 280/87.042

(58) Field of Classification Search
CPC ..... A63C 17/0046; A63C 17/0093; A63C 17/016; A63C 2017/1472
USPC ..... 180/221, 342; 280/87.042, 47.22
See application file for complete search history.

(56) References Cited

U.S. PATENT DOCUMENTS

| | | | | |
|---|---|---|---|---|
| 4,394,029 | A | 7/1983 | Holmgren | |
| 5,160,155 | A | 11/1992 | Barachet | |
| 6,926,294 | B2 | 8/2005 | Lewis | |
| 7,669,681 | B2 * | 3/2010 | Lee | 180/221 |
| 2005/0230930 | A1 | 10/2005 | Chung | |
| 2007/0246308 | A1 | 10/2007 | Sauve et al. | |
| 2010/0108423 | A1 | 5/2010 | Keel | |

* cited by examiner

*Primary Examiner* — John R Olszewski
*Assistant Examiner* — Brian Cassidy
(74) *Attorney, Agent, or Firm* — Antony C. Edwards

(57) ABSTRACT

An in-line off-road skateboard includes a front wheel and a rear wheel in tandem, one foot platform mounted between the front and rear wheels and one foot platform mounted aft of the rear wheel, an articulating front wheel which is steered by tilting the board in the desired direction of travel, a steering assembly which is adjusted to control the radius of a turn and the level by which the steering assembly is able to respond when the board is leaned from side to side at various degrees, independent suspension for both wheels that can be adjusted for various lengths of wheel travel and for various types of terrains, and a rear disc brake that does not interfere with the ability of the rear suspension to respond to uneven surfaces.

12 Claims, 14 Drawing Sheets

IN-LINE OFF-ROAD SKATEBOARD

CROSS REFERENCE TO RELATED APPLICATION

This application claims priority from U.S. Provisional Patent Application No. 61/336,022 filed Jan. 15, 2010 entitled In-Line Off-Road Skateboard, and is incorporated herein by reference.

FIELD OF THE INVENTION

This invention pertains to the field of skateboards, and specifically to the field of in-line skateboards designed for off-road use.

BACKGROUND OF THE INVENTION

With the interest in mountain biking gaining in popularity a new type of trail system is emerging; trails that are designed specifically for two wheeled cycles. Such trails have an incline with banked corners and obstacles of dirt, rock and wood which are fashioned to either propel the bike and rider into the air or test the rider's balance. Such trails are often rough, narrow, and have sharp turns. Therefore, to ride these trails mountain bikes have acquired long travel independent suspension systems, disc brakes that do not compromise suspension performance and special steering geometry.

New ways to experience these trails are inevitable. With the current popularity of surfing, snow boarding, skateboarding, mountain boarding and inline boarding it is fitting that a vehicle that would allow a person to ride these trails standing in a surfing manner would be desirable. However, conventional mountain boards are unable to navigate these single track trails effectively because such boards are double tracked, have small wheels, little ground clearance and minimal suspension travel. Although conventional inline boards are single tracked and offer larger wheels, they are also insufficient because most lack independent suspension, adequate suspension travel, and a wheel base that allows for adequate ground clearance and for sharp turns.

It is therefore an intent of this invention to produce an inline board that can be ridden in a surfing stance on rough, narrow, and winding single track trails. It is comprised of two relatively large diameter wheels positioned lengthwise in-line with each other. The wheels rotate about axes which are parallel in relation to each other and lateral in relation to the length of the board. The front wheel articulates so that it can be steered by tilting the deck into the direction of intended travel. Both wheels are able to move vertically to travel over uneven surfaces and to absorb the impact of harsh landings resulting from various obstacles. The center of gravity is low, while permitting a relatively large range of vertical wheel travel. A suspension system is provided that does not alter steering geometry.

The steering system of this invention is an improvement over that of my U.S. Pat. No. 6,926,294 B2. The steering system of U.S. Pat. No. 6,926,294 B2 steers very responsively as long as the board is tilted laterally left or right at small degrees off of the horizontal plane. However, after the board of U.S. Pat. No. 6,926,294 B2is tilted beyond these initial degrees away from horizontal the steering becomes less and less responsive until ultimately the front wheel will not turn further at all and, with further tilting, returns to a straight-ahead alignment. My present invention improves the steering system of U.S. Pat. No. 6,926,294 B2 so that it will provide responsive steering even when the board is tilted left or right at more extreme angles away from the horizontal plane, and so that it will self-align once the board is returned to the horizontal plane and will provide a stable predictable means of regulating the movement of the steering assembly.

In the prior art, I am also aware of German Patent DE 101,00,072 B4. The German board in German Patent DE 101,00,072 B4 (herein the "German board") varies the angle of the steering axis. The angle of steering axis on my board is constant. What varies on my board is the forward offset of my front wheel in relation to the steering axis. The wheel base remains constant on the German board when it is turned. My wheel base is decreased as it is steered away from straight ahead.

The differences are significant when it comes to the performance of the boards. At straight ahead alignment the German board has a steep steering angle. As the board is turned away from straight ahead the steering angle is leaned backwards. It is well established in the bicycle world that a steeper steering angle will produce a smaller turning radius and snappier steering. For example: Cross Country bikes generally have 71 degree steering axis angle for slow speeds and tight turns. On the other hand, Down Hill bikes can have as little as a 63 degree steering axis angle for larger radius turns at higher speeds. My point is that the German board starts to turn with a tight steering radius and as it is leaned increases its turning radius. In other words, the more the board is leaned the less the board will turn.

To perform a tight turn on my deck the deck must be tilted far away from horizontal. To perform a large radius high speed turn the deck must only be tilted a little off horizontal.

The steering characteristics of the German board are counter intuitive. Most popular board sports like surfing, skateboarding, snowboarding, and wakeboarding operate on the principle that as the tilt of the board is increased away from horizontal the turning radius is decreased. My board works on this principle. My steering axis angle remains constant but as the board is tilted away from horizontal the wheel becomes more responsive to turning, therefore, reducing the turning radius.

SUMMARY OF THE INVENTION

An in-line off-road skateboard includes a front wheel and a rear wheel in tandem, one foot platform mounted between the front and rear wheels and one foot platform mounted aft of the rear wheel, an articulating front wheel which is steered by tilting the board in the desired direction of travel, a steering assembly which is adjusted to control the radius of a turn and the level by which the steering assembly is able to respond when the board is leaned from side to side at various degrees, independent suspension for both wheels that can be adjusted for various lengths of wheel travel and for various types of terrains, and a rear disc brake that does not interfere with the ability of the rear suspension to respond to uneven surfaces.

The skateboard includes a frame constructed out of steel or aluminum tubing. The foot platforms are fastened onto the top of the frame. The two tubes of the frame that support the platforms are laterally spaced apart and parallel to each other and surround both sides of the rear wheel. The front platform is horizontal under the front foot. The rear platform angles slightly upward under the rear foot. Mounted rigidly in front of and above the front platform is a horizontal tube that is perpendicular with respect to the length of the board that is the longitudinal axis of the board. This tube is the axle for the front swing arm. The swing arm axle tube may be attached to the horizontal frame members by two generally vertical tubes in front of the front platform.

The front swing arm extends substantially longitudinally forward from the horizontal axle tube. The front swing arm axle extends laterally, perpendicular to the rear end of the front swing arm and is mounted in to the axle on ball bearings. A second lateral tube is mounted to the front of the swing arm so as to parallel the swing arm axle. The second lateral tube is the front tube of the swing arm and houses the lateral axle of the steering head tube. The lateral axle of the steering head tube pivots on ball bearings within the front tube of the swing arm and is secured within the axle housing by a clamp that also serves as a bell-crank linkage. The bell crank linkage connects to a tie rod which parallels the front swing arm and attaches to one of the generally vertical frame tubes. In one embodiment the tie rod includes a shock mounted between oppositely disposed tie rod ends, connecting, respectively, one the generally vertical frame tube with the bell-crank linkage. Upward movement of the front swing arm compresses the shock. The front swing arm and tie rod from a parallelogram linkage which controls the front wheel's travel.

The steering assembly is mounted pivotally to the steering head tube, collectively herein the steering column, and inside the front wheel so as to align the steering axis with the centerline longitudinal axis of the board. To accomplish this the wheel hub is mounted offset laterally to one side of the longitudinal axis of the board thus permitting the steering head tube to be centered on the longitudinal axis of the board. Since the hub is to one side of the longitudinal axis of the board the rim is also extended laterally beyond the tire on the same side as the hub. The portion of rim that extends laterally of the tire provides a location to fasten the wire spokes of the front wheel.

The steering assembly consists of a main tube and an aluminum clamp fastened at the top of the tube. The clamp covers the top end of the steering head tube. The steering assembly rotates within the steering head tube. At the bottom of the main tube of the steering assembly is the pivot housing for the axle offset linkage of the front wheel.

The pivot of the wheel axle offset linkage lies below, forward and parallel to the front wheel axle. The top of the linkage is clamped to the wheel axle. The lower end of the linkage rotates on a pin or shaft mounted to the pivot housing. A bolt may serve as the pivot axle. The forward end of a short tie rod is pivotally mounted to the rear of the axle offset linkage. The rear end of the tie rod is pivotally anchored to the head tube assembly, for example by a rigid strut.

The rear suspension includes a pair of swing arms which form a fork which surrounds the back half of the rear wheel. The leading ends of the fork are mounted to the rear wheel axle. The rear-most trailing ends of the swing arms are mounted to a pivot axle. The pivot axle is located just aft of the rear wheel, between the rear wheel and the rear platform.

In summary, benefits of the present invention include one or more of the following: The forward offset of the front wheel's transverse rotational axis is variable in relation to the steering axis, and varies depending upon how far the front wheel is steered away from straight ahead. The front wheel re-aligns to straight ahead under the force of gravity acting on the frame and rider due to the slight lifting of the frame as the front wheel is turned left or right. The front suspension design maintains a constant steering axis angle during the front wheel's vertical travel. The steering axis is manually adjustable. The front wheel has a laterally offset hub that is laced to wire spokes. The use of wire spokes is an improvement. The front suspension uses only a single sided front swing arm. The shocks are uniquely placed front and back. The rear suspension is a multi-pivot rear suspension which pivots the swing forks from behind the rear wheel. The floating brake system provides braking forces over a large range of vertical rear wheel travel.

BRIEF DESCRIPTION OF THE DRAWINGS

FIGS. 11 and 11*a* illustrate that the steering axis angle can be manually altered by adjusting the bell-crank linkage.

DETAILED DESCRIPTION OF EMBODIMENTS OF THE INVENTION

Figure 1:
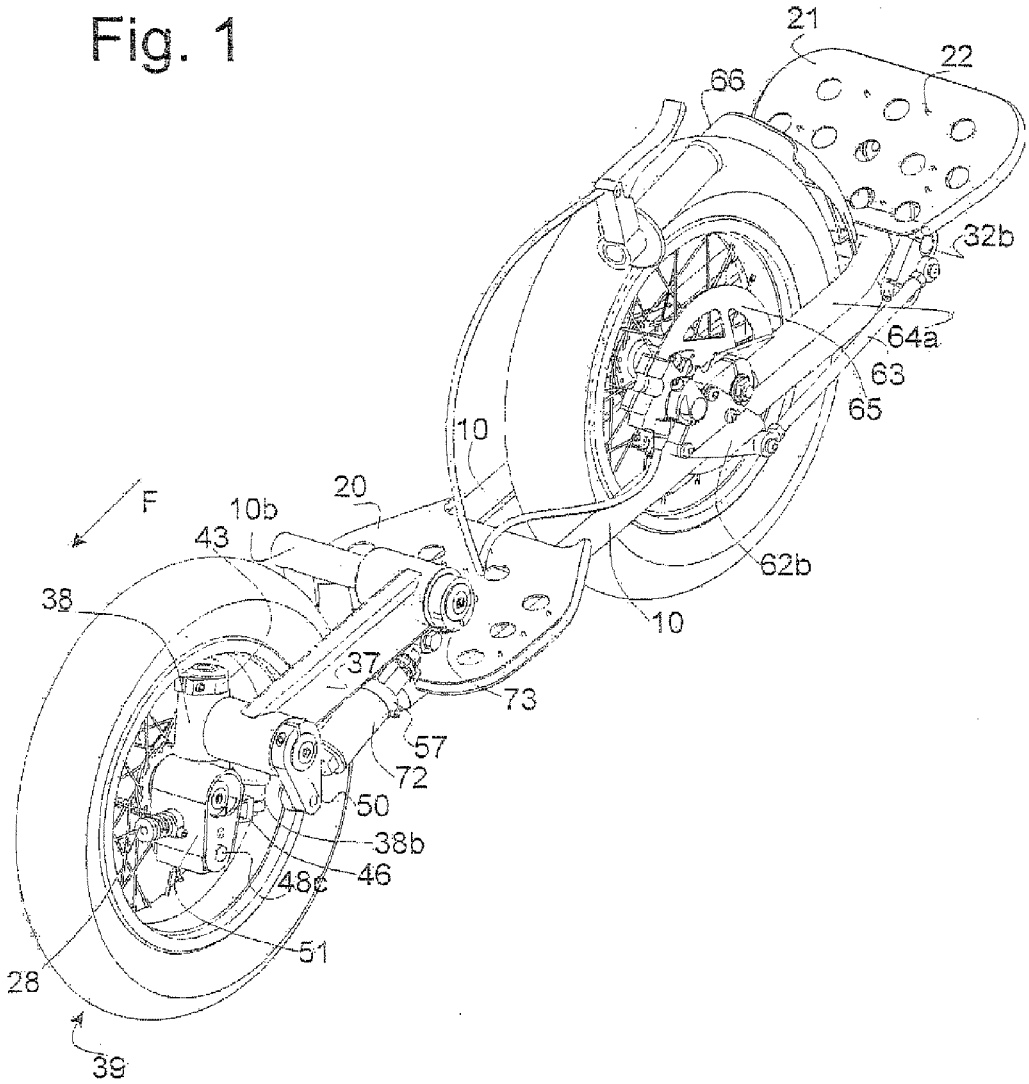
FIG. 1 is a front perspective view of the skateboard according to one embodiment of the present invention.

A detailed listing of parts is found at the end of the description. In the various Figures, like reference numerals and characters are intended to denote corresponding parts in each view.

The in-line off-road skateboard according to one embodiment of the present invention includes a frame 10, for example constructed out of steel or aluminum tubing. Rigid front and rear platforms 20 and 21 are fastened onto the top of the frame. Front platform 20 is between the wheels. The rear platform 21 is positioned to the rear of the rear wheel. The two laterally spaced apart, longitudinal tubes of the frame 10 that support the platforms are parallel to each other and surround both sides of the rear wheel. The tubes are horizontal under the front foot platform 20. The rear foot platform 21 is tilted upward at the rear. Just in front of and above the front standing platform 20 is an elevated horizontal tube 10*b* mounted on a pair of vertical supports 10*d*. Tube 10*b* is perpendicular relative to the longitudinal axis K of the skateboard (also referred to herein merely as a "board"). The perpendicular tube 37*b* mounted to the rear end of front swing arm 37 is the axle housing for the front swing arm 37. Vertical supports 10*d* are welded to the horizontal frame members of frame 10.

Figure 2:
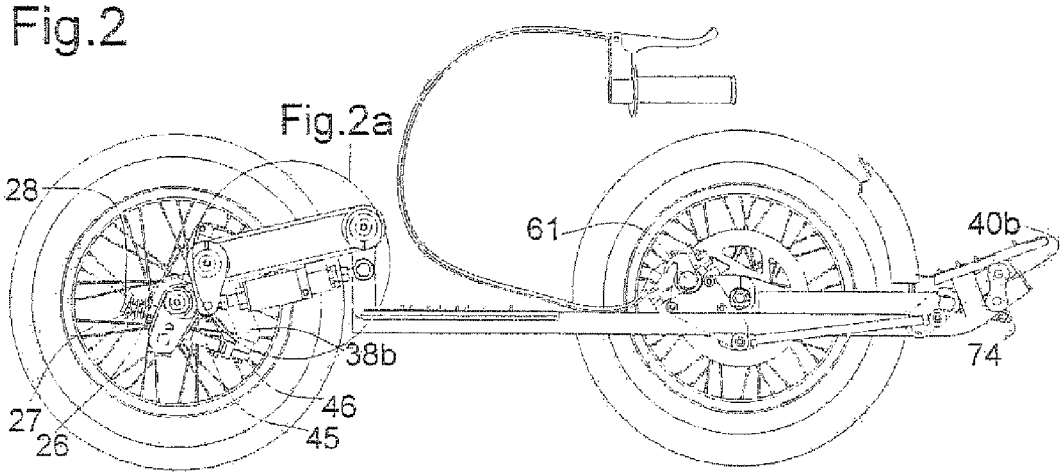
FIG. 2 is a left side elevation view of the skateboard of FIG. 1.
Figure 2A:
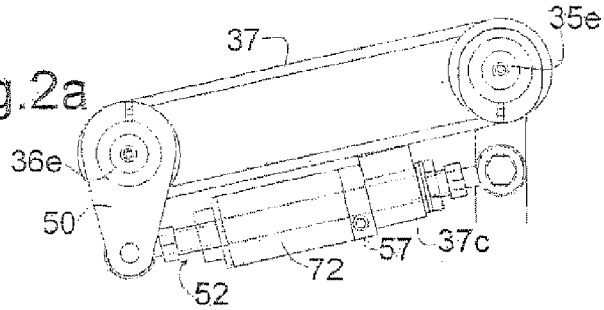
FIG. 2*a* is an enlarged view of a portion of FIG. 2.
Figure 3:
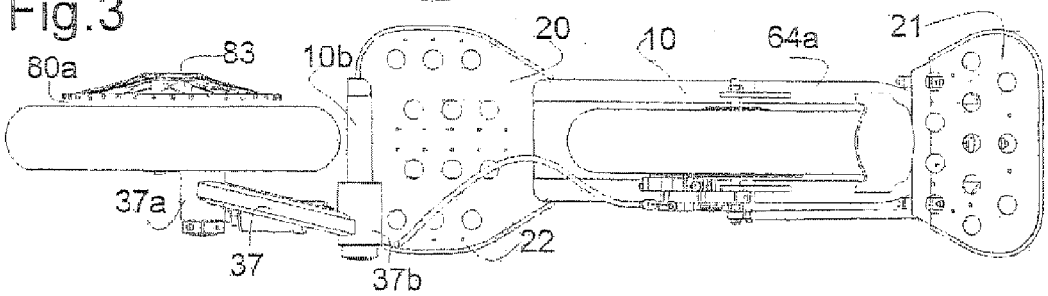
FIG. 3 is a plan view of FIG. 2.
Figure 4:
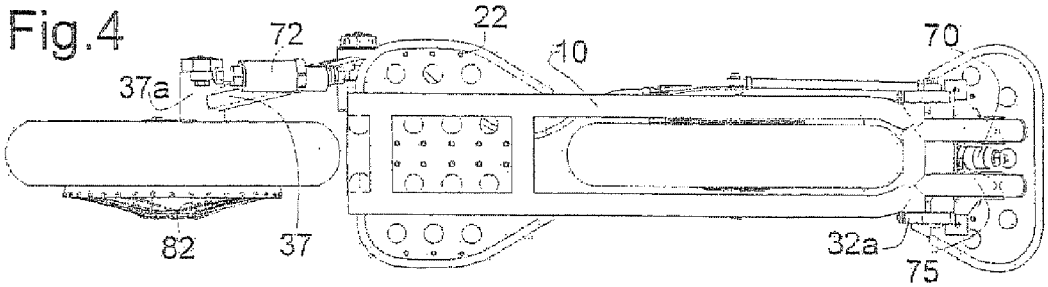
FIG. 4 is an underside view of FIG. 2.
Figure 5:
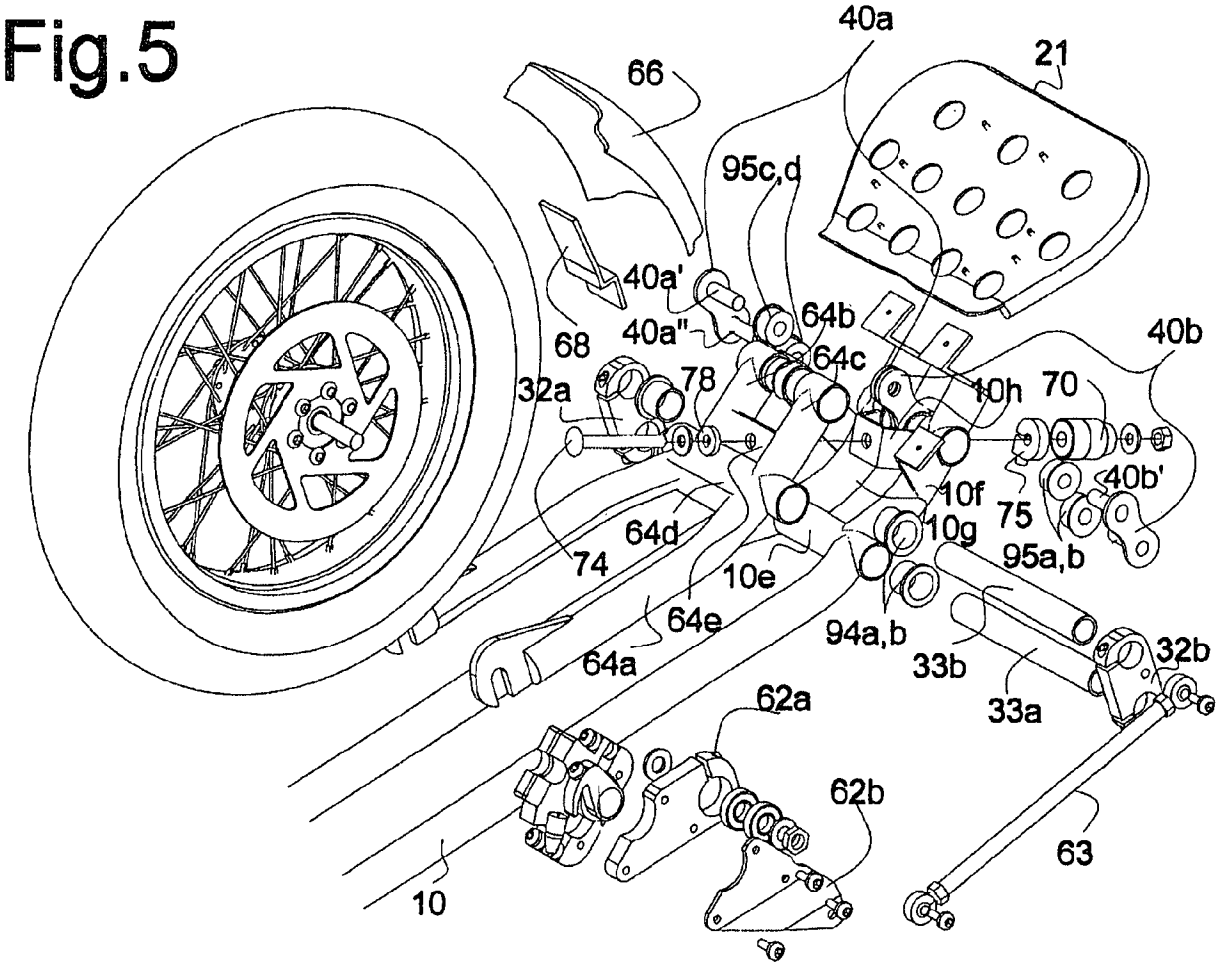
FIG. 5 is, in perspective exploded view, the rear of the skateboard of FIG. 1.
Figure 6:
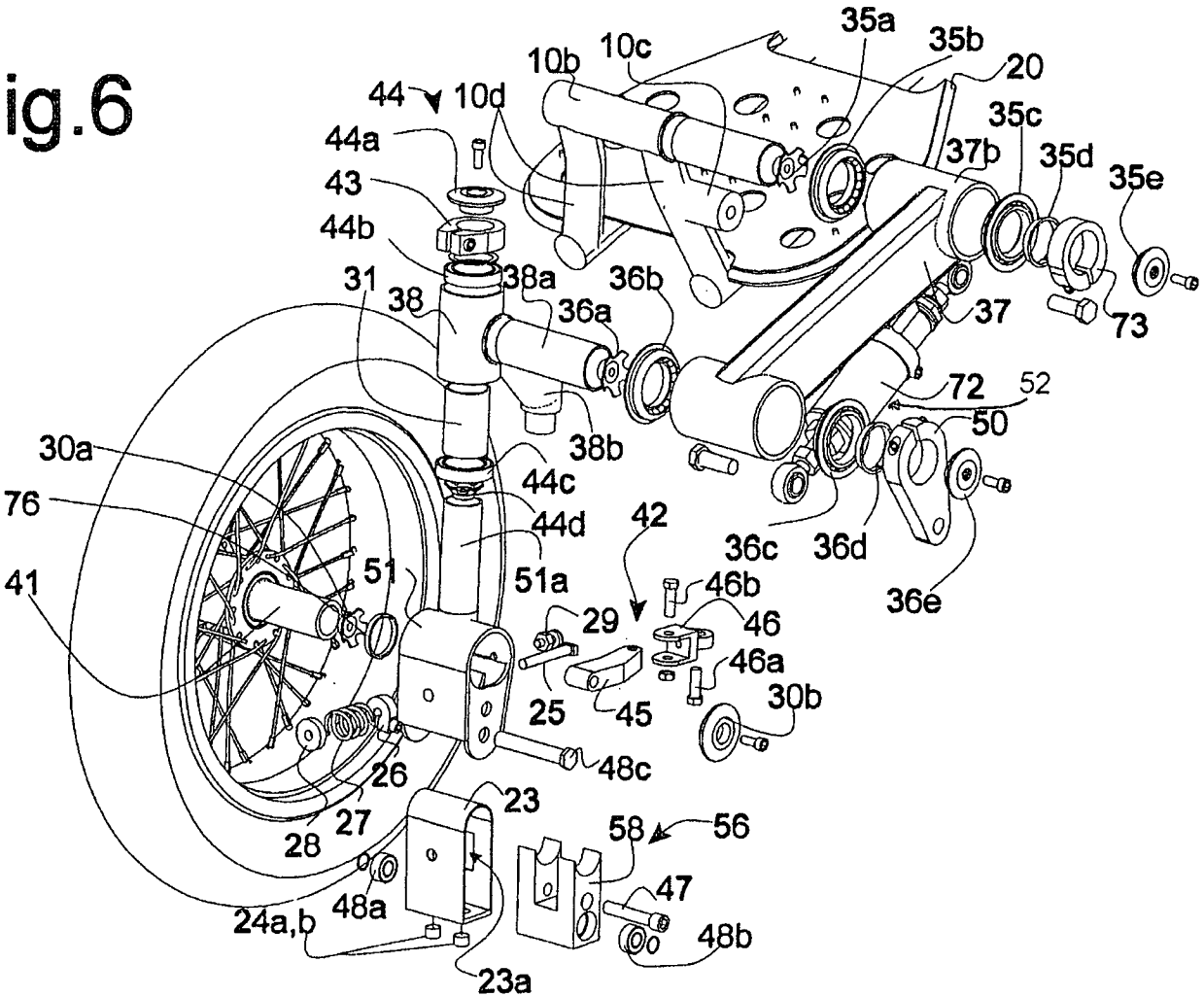
FIG. 6 is, in front perspective exploded view, the front of the skateboard of FIG. 1.
Figure 6A:
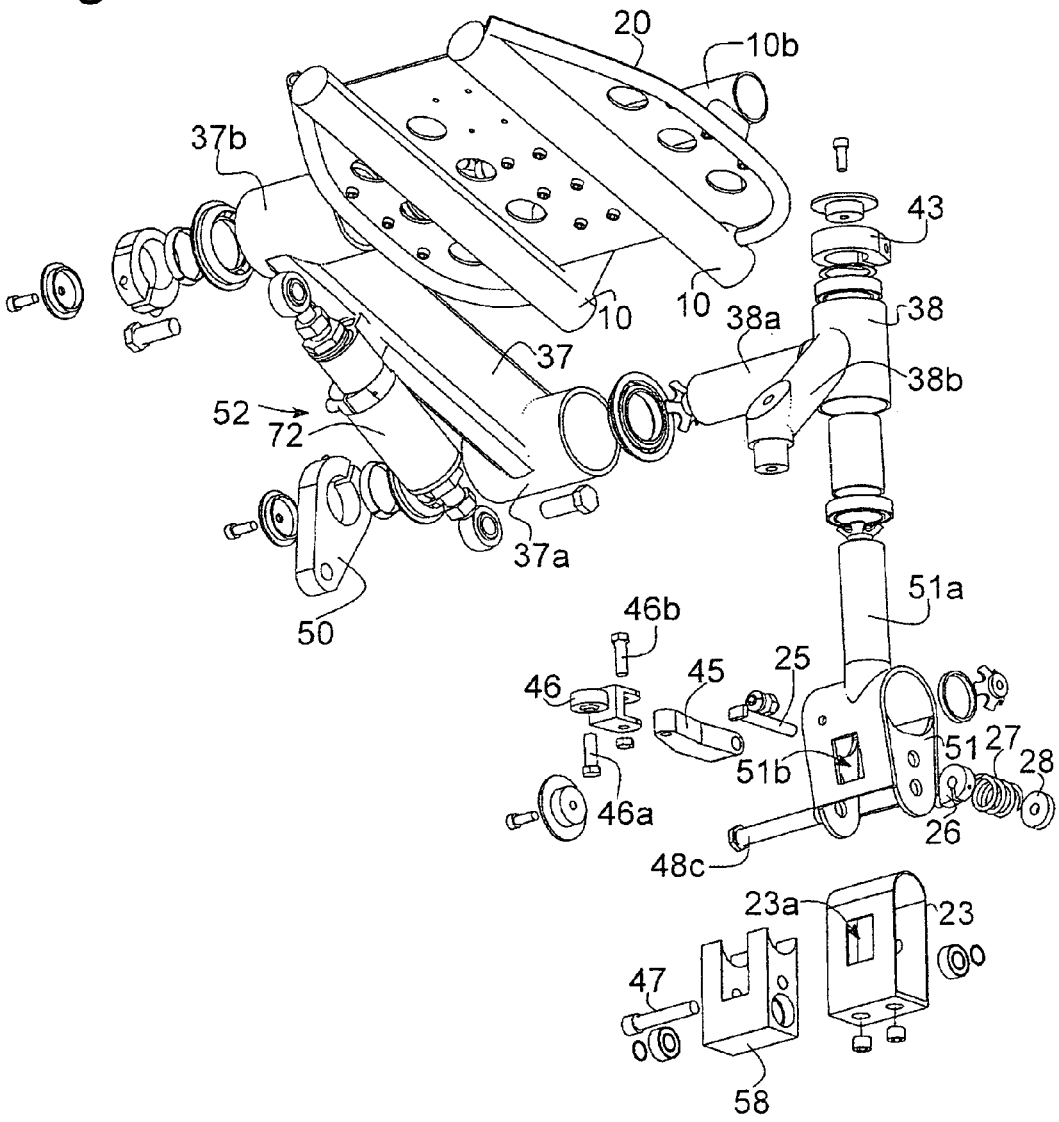
FIG. 6*a* is, in rear perspective exploded view, the skateboard of FIG. 6.

Swing arm 37 is rotatably mounted on tube 10*b*. A headset 35*a*-35*e* is mounted between tube 10*b* and tube 37*b*. Tube 37*a* is mounted at the leading front end of the swing arm 37. Tube 37*a* parallels tube 37*b*. Front tube 37*a* houses the lateral axle 38*a* of the steering head tube 38. The lateral axle 38*a* pivots on headset 36*a*-36*e*. The lateral axle 38*a* of the steering head tube 38 is secured within the axle housing tube 37*a* with an aluminum clamp 50 that also serves as a bell-crank link that connects the front end of the front swing arm 37 to the front of the tie rod/shock shaft 52. The tie rod/shock shaft 52 parallels the front swing arm 37 and is pivotally mounted to mount 10*c* on one of the generally vertical frame tubes 10*d*. The resulting parallelogram, as seen in FIG. 2*a*, between the swing arm 37 and tie rod/shock shaft 52 enables the front wheel assembly 39 to move vertically without altering the geometry of steering axis B.

The steering assembly or steering column is mounted inside the front wheel assembly 39. To accomplish this the wheel hub 83 was mounted offset to one side of the longitudinal axis K of the board, to the side opposite swing arm 37, thus permitting axis B of steering head tube 38 to be centered on and intersect with the longitudinal axis K of the board. The aluminum hub 83 resembles a typical bicycle hub which relies on two sets of sealed bearings 84 which are pressed into each end of the hub body. The hub rotates on a large diameter steel or aluminum axle 41. A lateral flange 80*a* on rim 80 extends laterally beyond the tire. Threaded wire spokes 82 are laced from the wheel hub and fastened to the lateral rim flange 80*a* by means of threaded spoke nipples 90. The hub 83 is rotatably mounted on axle 41 and secured between axle flange 41*a* on axle 41 and the axle swing or offset or rocker link 58 which is clamped to the axle 41.

Figure 15:
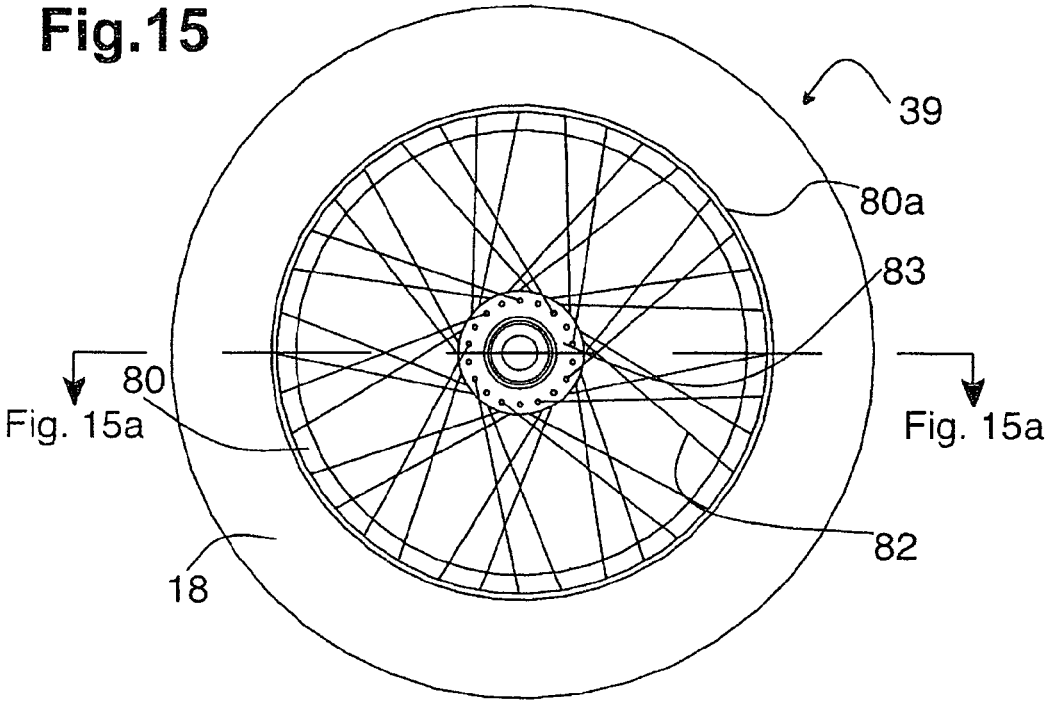
FIG. 15 is an enlarged right side elevation view of front wheel assembly illustrating the point of the cross sectional.
Figure 15A:
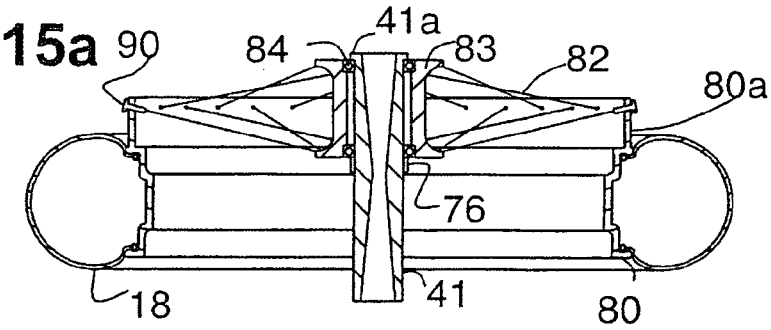
FIG. 15*a* is a cross sectional view along line 15*a*-15*a* in FIG. 15.
Figure 15B:
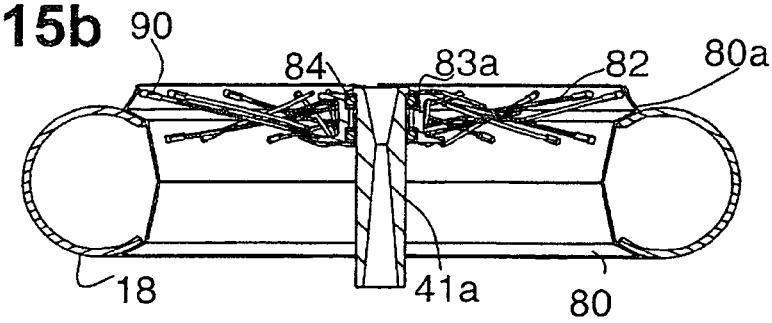
FIG. 15*b* is the cross section of FIG. 15*a* showing an alternative embodiment of how the spokes are inter-laced.

FIGS. 15*a* and 15*b* differ in how the spokes are laced from hub to rim. FIG. 15*b* shows that the spokes of the outside hub flange cross laterally with the spokes of the inner flange. The spokes of the outside hub flange attach towards the center of the rim and the spokes of the inner hub flange attach to the outer edge of the rim. There are advantages to both designs. The spoke configuration of FIG. 15*a* provides more space inside the wheel to accommodate the tie rod assembly. The spoke configuration of FIG. 15*b* provides a potentially stronger and lighter wheel. It is stronger because the spokes support the rim closer to the center of the rim. It is lighter because the hub and axle is shortened.

My steering system includes two characteristics: the ability to steer away from straight ahead; and, the ability to return itself back to straight ahead. On the first point, the more the board is tilted the more it turns. This aspect of the steering system was one result of my experiments. The second aspect of my steering system, which was unexpected is the tendency of the front wheel to self-align. I have found that it is not the manipulation of the trail that causes the front wheel to self-align, it is instead the fact that the front wheel moves slightly downward as the front wheel turns away from straight ahead alignment. Pivot positions that only move the wheel back but not down allow the board to be steered left and right with ease, but are difficult to direct straight ahead.

Figure 17:
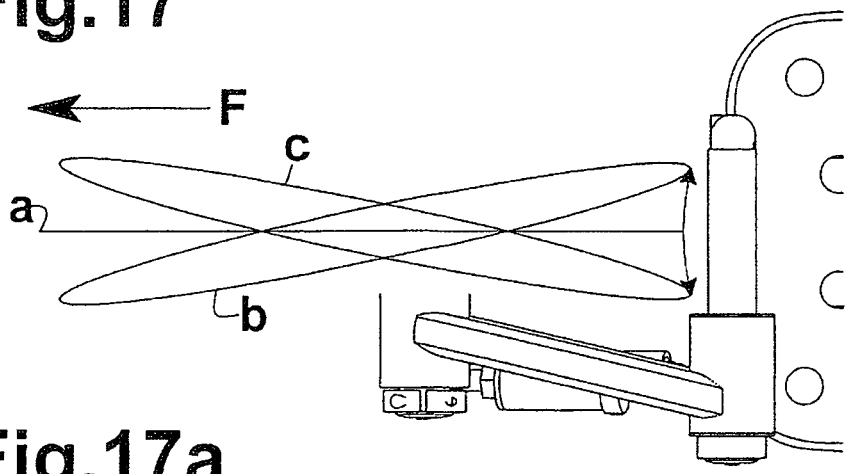
FIG. 17 is a simplified top view of the range of steering motion of the front wheel.
Figure 17A:
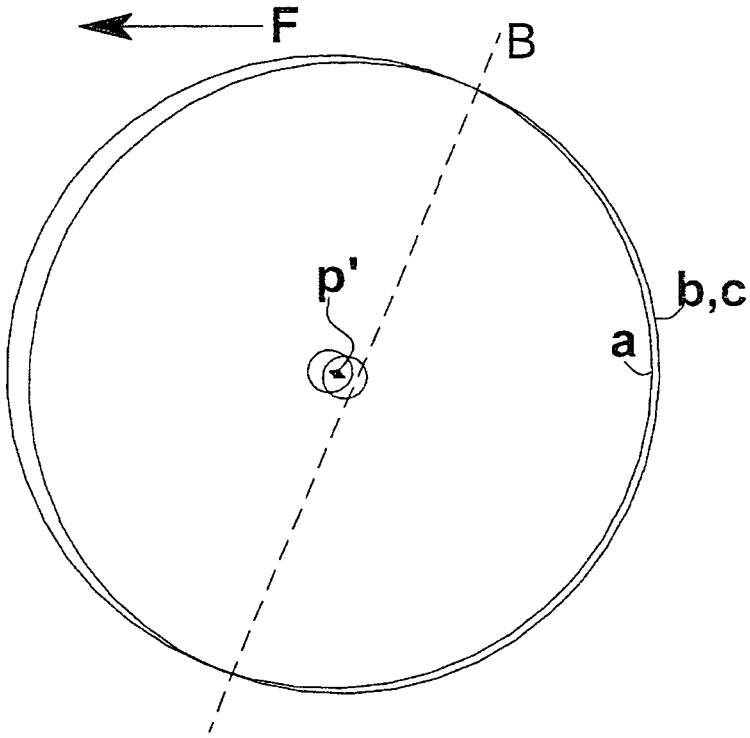
FIG. 17*a* is a side view of the range of steering motion of the front wheel.

FIG. 17A illustrates in simplified form how the wheel moves down as it is turned left and right. In actuality it isn't the wheel going down but the frame and rider being lifted up (as the ground level is fixed). It is thus gravity that is urging the board and rider to return the front wheel to straight ahead alignment so that board and rider can be at the lowest possible point.

The steering assembly includes the steering tube 51*a* mounted in the steering bearing assembly 44, clamped by aluminum clamp 43. Clamp 43 fastens at the top of the tube 38. The clamp 43 covers the upper end of the steering head tube 38.

The pivot axis of the axle rocker linkage lies below, forward and parallel to the axle 41 of the wheel. The linkage bolt 48*c* of rocker link 58 pivots on sealed bearings 48*a* and 48*b* that are pressed into the housing. A tie rod assembly 42 acts between a rigid strut formed by lower tube 38*b* and rocker link 58. The wheel axle rocker link is connected to the short tie rod assembly 42 by bolt 47. The trail adjusting linkage such as tie rod assembly 42 includes trailing arm 45 and swing link 46.

When the board is tilted laterally left or right of its longitudinal axis, precession and gravitational force on the wheel causes the front wheel to turn into the lean. As the tilt angle of the board is increased, the short tie rod assembly 42 of trailing arm 45 and swing link 46 swings sideways thus pulling the front wheel axle offset linkage backwards and downwards. The forward offset of the front wheel axle is decreased as the board continues to turn. The sideway force on the wheel is increased assisting the wheel in continuing to turn. As the board is tilted, the axis D of the wheel is pulled downward by the short tie rod assembly 42. Therefore, the board and its rider are lifted to accommodate this action as the ground plane is fixed. As the board is returned to parallel with the ground plane, gravitational force urges the rider and board downwards. This causes the front wheel to self align to straight ahead alignment in direction F (in FIG. 17).

Figure 7:
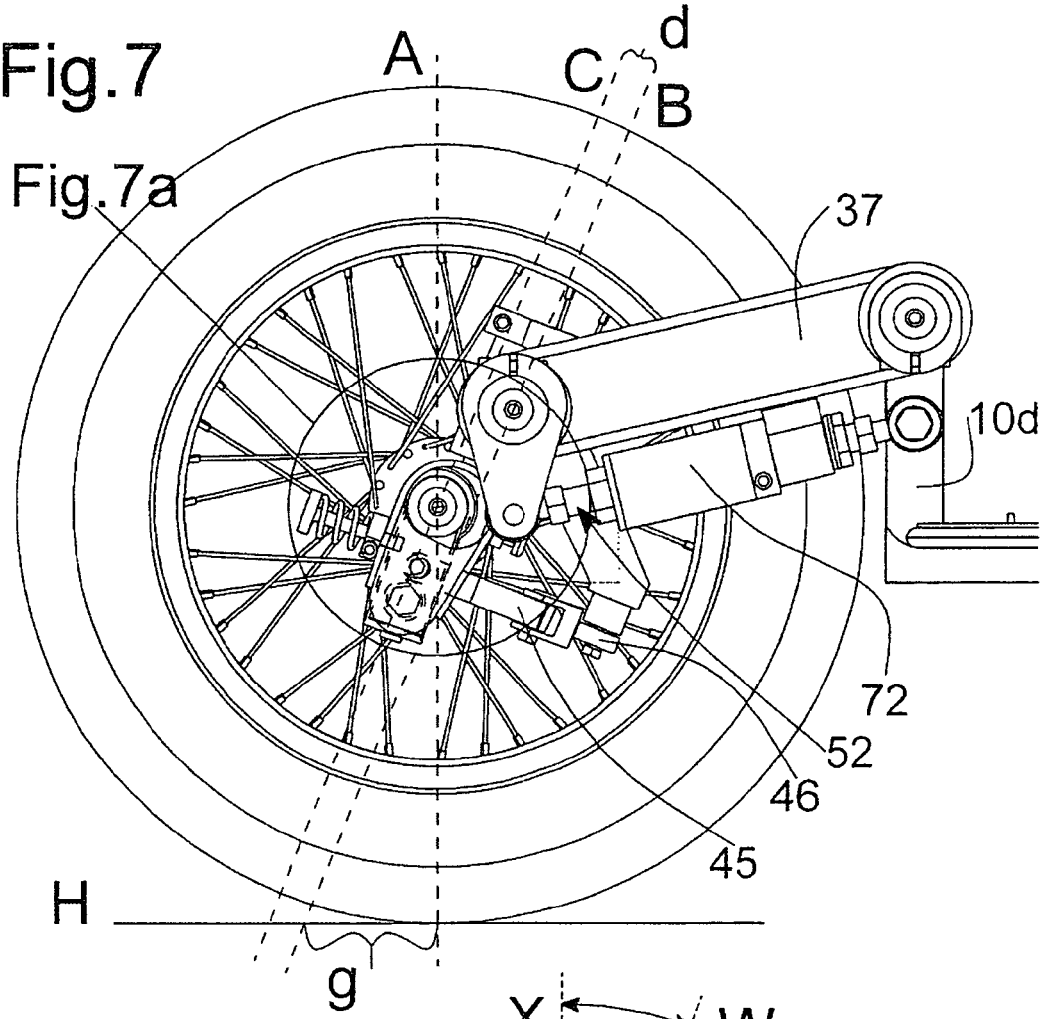
FIG. 7 is an enlarged partially cut-away view showing in side elevation the front wheel in its lowered at-rest position and with the steering assembly at straight alignment so as to be aligned with the longitudinal axis of the skateboard.

FIG. 7 illustrates the front wheel and steering assembly at straight-ahead alignment. Axis B is the axis along which the steering tube 51*a* rotates within the steering head tube 38. Axis A is the vertical axis that intersects the transverse rotational axis D of the front wheel. When compared to the vertical axis A it becomes apparent that the steering axis B is inclined towards the rear of the board. Line C intersects the rotational axis D and parallels axis B. Line C illustrates that the rotational axis D of the wheel is forward of steering axis B. The distance at which the wheel axis D is forward of the steering axis is represented by d. The horizontal ground plane H represents the ground over which the tires travel.

As would be known to one skilled in the art, so-called trail is the horizontal distance from the point at which the vertical axis A intersects the ground plane H and the point at which the steering axis B intersects plane H. Trail is represented by dimension g.

Figure 7A:
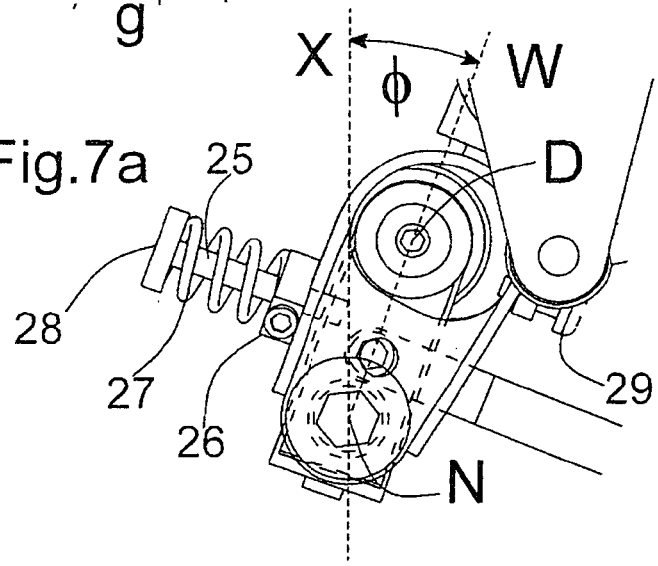
FIG. 7*a* is an enlarged partially cutaway portion of FIG. 7 showing the swing linkage for the front wheel axle.
Figure 8:
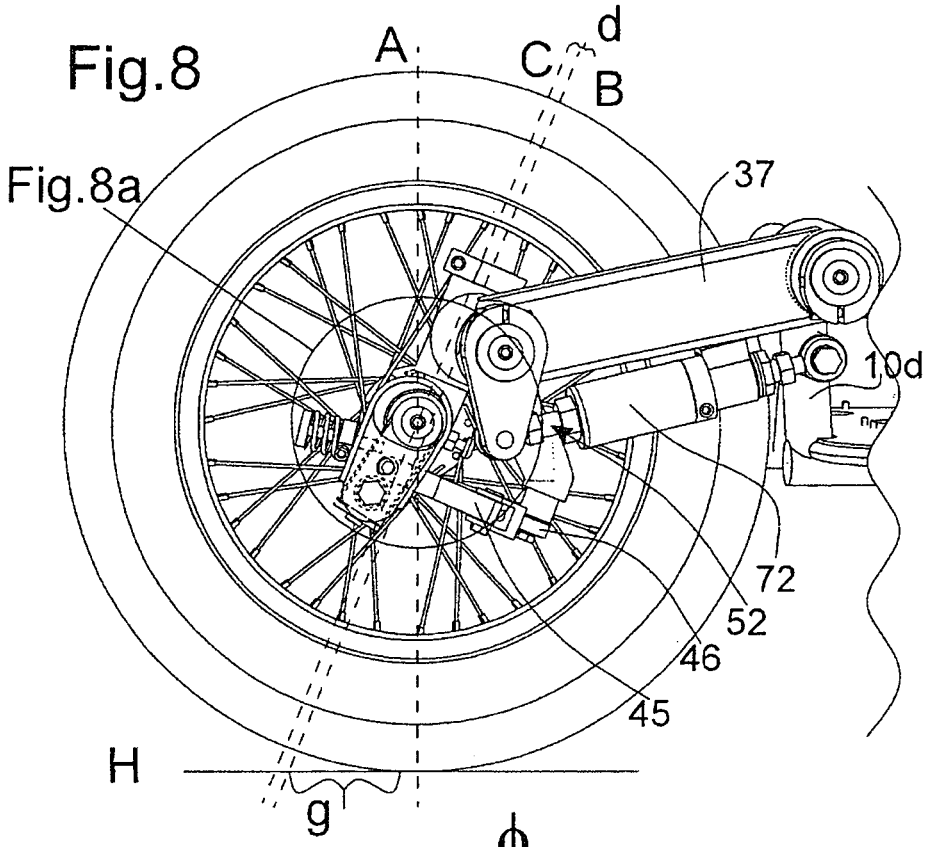
FIG. 8 is a left side view of the front wheel and the steering assembly of FIG. 7, with the front wheel turned to the right of straight-ahead alignment.
Figure 8A:
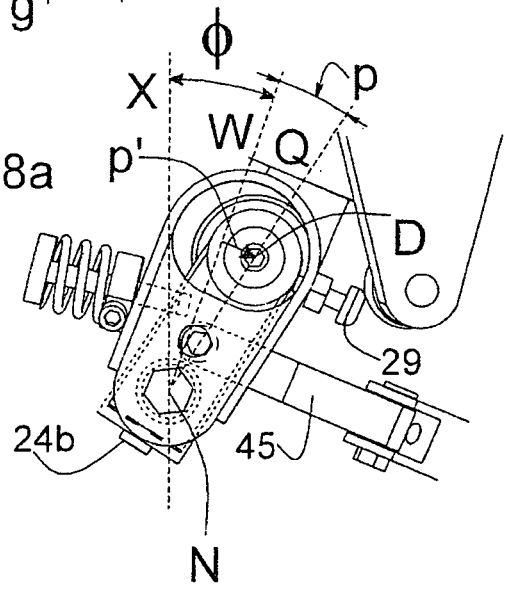
FIG. 8*a* is an enlarged partially cutaway portion of FIG. 8.

FIGS. 8 and 8*a* present a left side view of the front wheel and the steering assembly while the front wheel is turned to the right of straight-ahead alignment, and demonstrate that the rotational axis D of the front wheel has been moved rearward and downward from where axis D was located when the front wheel was at straight-ahead alignment as illustrated in FIGS. 7 and 7*a*.

In FIG. 8, as it was in FIG. 7, the letter d represents the distance by which the wheel axis D is forward of the steering axis B. In FIG. 8 line C still represents the forward offset of the wheel axis D in relation to the steering axis B. However, FIG. 8 demonstrates that wheel axis D and consequently line C has moved closer to the steering axis B. This can be confirmed by noting that the distance represented by d in FIG. 7 is greater than the distance separating the lines C and B when the wheel is turned away from straight-ahead alignment as seen in FIG. 8. Therefore, the wheel's rotational axis D is directed closer to the steering axis B as the wheel is turned away from its direct alignment with the centerline, that is, away from straight ahead alignment. There is less forward offset and the trail is increased as the wheel is steered away from straight-ahead alignment.

As already stated the steering axis is directly in line with the longitudinal centerline of the board. If the steering axis isn't completely centered with the front wheel and the board then the steering will be unequally responsive when turned left in comparison to turning the board right.

The trail of the front wheel is progressively increased as the front wheel is turned away from straight-ahead alignment. Again dimension g represents the trail or horizontal distance on plane H between the vertical axis A of the wheel and the intersection of steering axis B with plane H when the wheel is at straight-ahead alignment.

FIG. 7*a* is an enlarged partially cutaway portion of FIG. 7. It illustrates the left side of the front wheel axle offset linkage. Line X is the vertical axis which intersects the lower pivot axis N of the wheel axle offset swing linkage. Line W intersects the lower pivot axis N of the wheel axle swing link and the axis of rotation D of the wheel axle. In FIG. 7*a* the angle f of line w represents the angle, relative to line X, at which the swing link is situated when the front wheel is at straight-ahead alignment.

FIG. 17*a* illustrates the trajectory of wheel axis of rotation D when the wheel is steered away from the straight-ahead alignment position. The front wheel axle lowers (that is, the frame raises) as the front wheel turns from straight ahead. FIG. 8*a* also illustrates this trajectory or path. Again, line X is the vertical axis which intersects the axis of rotation N of the wheel axle rocker link 58. f again represents the angle in FIG. 7*a* between lines X and W, that is when the front wheel is at straight-ahead alignment as illustrated in FIG. 7*a*. Line Q intersects both axes D and N and represents the new position of the rocker link 58 when the front wheel is turned as in FIG. 8. As can be seen line Q is angles even further away from the vertical axis X than is line W and closer to the steering axis B. Consequently the axis of rotation D of the wheel is drawn increasingly closer to the steering axis B as the front wheel is increasingly turned away from straight-ahead alignment.

Angle p of FIG. 8*a* illustrates the movement or angular displacement of the wheel axis D relative to axis N as the link responds to the rotation of the front wheel away from straight-ahead alignment of the steering assembly on the steering axis B. Angle p demonstrates that as the wheel is turned away from straight-ahead alignment the upper end of the wheel axle offset rocker link rotates in an arc backwards and downwards towards steering axis B.

The path and direction that the rocker link takes is important for the steering performance of the skateboard. The path p' in FIG. 8*a* and 17*a* is the trajectory of the movement of axis D corresponding to the arc across angle p in FIGS. 8*a*. Path p' demonstrates that, because the vertical distance between axis D and ground plane H is fixed, it is necessary for the skateboard and rider to be lifted in order for the board to turn. Therefore, the vertical element of the wheel axle path p' utilises gravitational force to help restrict the range of motion of the front wheel when the board is tilted and to self-align the wheel when the board is parallel with the ground. The vertical element of the wheel path needs to be in balance with the horizontal element. Too much vertical movement will counteract the benefits of the increased trial and prevent the wheel from steering away from straight ahead alignment. Too little vertical movement will produce very responsive steering but counteract the self-alignment of the front wheel. The horizontal element of the wheel axle path p is important because the more the wheel is moved backwards the more the steering becomes responsive to sideway forces when the board is tilted. The path that the axle takes affects the stability and responsiveness of the steering system.

Figure 9:
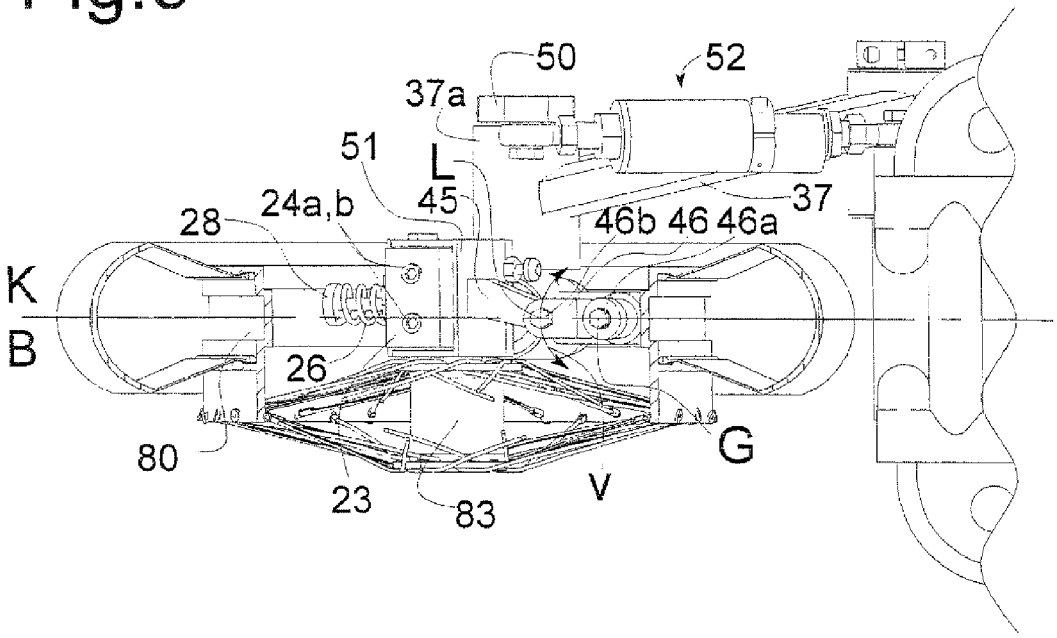
FIG. 9 is a plan view of the underside of FIG. 7 with the wheel partially cut-away to expose the steering assembly at straight-ahead alignment.

FIG. 9 is a plan view of the underside of FIG. 7. which includes a partial cut away of wheel to expose the steering assembly at straight-ahead alignment. Broken line K represents the longitudinal centre axis of the skateboard. At straight-ahead alignment the front tire, steering axis B (which appears in this view as co-linear with axis K), tie rod pivot axis L (which is mounted to the axle offset swing link assembly) and tie rod pivot axis G (which is mounted to the head tube assembly) are all centered on longitudinal centerline axis K of the board.

Figure 10:
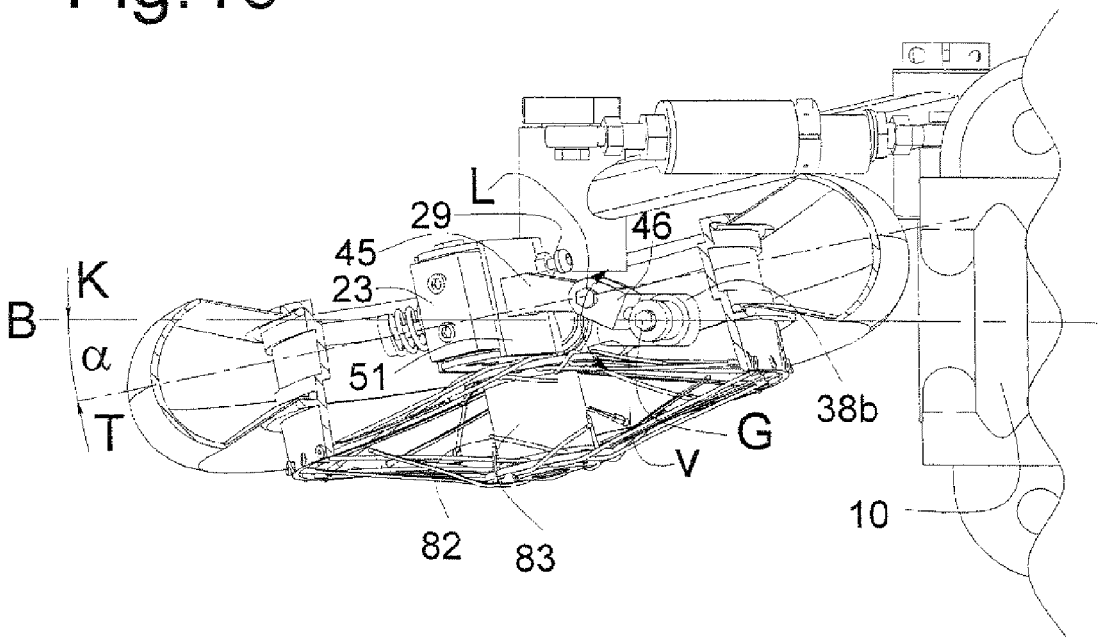
FIG. 10 is the view of FIG. 9 with the front wheel is turned to the right of straight-ahead alignment.

FIG. 10 is an enlarged plan view of the under side of FIG. 8 and includes a partial cut away of wheel to expose the steering assembly while the front wheel is turned to the right of straight-ahead alignment.

As can be seen in FIG. 10 steering axis B and tie rod axis G remain on the longitudinal axis K even when front wheel is steered away from straight-ahead alignment. Line T represents the centerline of the front wheel tire. Angle $\alpha$ indicates the angle at which the centerline T is turned away from the longitudinal axis K of the board. The steering axis B is located at the point where the longitudinal axis of the board intersects the centerline of the front wheel. When the steering assembly is pivoted away from straight-ahead alignment swing link 46 pivot axis L orbits the steering axis B. Pivot axis G of mounting pivot 46*a* of the swing link 46 is mounted to the lower tube 38*b*.

As stated above, housing 51 is mounted to the lower end of steering tube 51*a*. Housing 51 is hollow and sized to contain rocker link 58 encased in shell 23. Wheel axle 41 is clamped between the cupped upper end of cradle 58 and the saddle or domed upper end of shell 23. Bolts 24*a* and 24*b* tighten the clamping of axle 41 between cradle 58 and the saddle of shell 23. Cradle 58 is u-shaped. Collectively cradle 58 and shell 23 form a rocker link 56.

Rocker link 56 is pivotally mounted within housing 51 on bolt 48*c*, so that the upper end of the rocker link is free to rock back and forth within the housing about the lateral pivot axis N provided by bolt 48*c*.

Housing 51 has an opening or window 51*b* on its rear wall. Shell 23 also has an opening or window 23*a* which is aligned with the opening in the rear wall of housing 51 when rocker link 56 is mounted in the housing. Trailing arm 45 extends through both openings and is pivotally mounted on bolt 47 which extends laterally across the opening in the u-shaped cradle 58. The trailing or rear end of trailing arm 45 is thus free to move vertically as trailing arm 45 rotates on bolt 47.

The rear end of trailing arm 45 is pivotally mounted on vertically aligned bolt 46*b* to the forward end of swing link 46. Swing link 46 is anchored to tube 38*b*. As the front wheel turns out of straight ahead alignment and wheel axle 41 rotates rearwardly and downwardly on rocker link 56 under the influence of assembly 42, trailing arm 45 rotates in a vertical plane on bolt 47 and rotates in a horizontal plane on bolt 46*b* thereby providing a universal joint of sorts that allows assembly 42 to operate without binding as it ties the free end of the rocker link to the anchor provided by tube 38*b*.

Therefore, when the front wheel and steering assembly turn away from the longitudinal centerline axis K of the skateboard, the steering tie rod axis G stays on the skateboards centerline, and since the swing linkage assembly 42 is free to pivot on bolt 47, tie rod bolt 46*a* and its pivot axis L is free to travel without binding in an arc v around axis G. As tie rod pivot axis L travels in an arc path v around axis G of pivot 46*a*. The trailing arm is pulled in a manner to conform with arc v. Therefore, the tie rod assembly 42 allows centerline T of the wheel to turn away from the longitudinal centerline K of the board while progressively adjusting the offset of the front wheel axis D in relation to the steering axis B.

Figure 12:
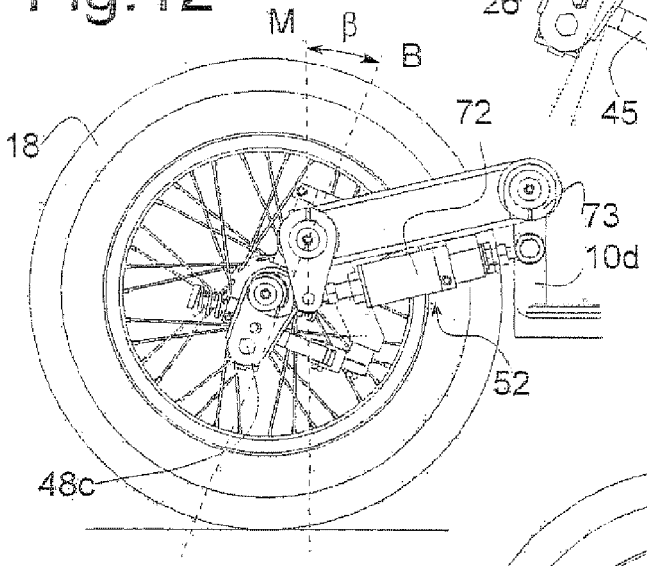
FIG. 12 is an enlarged view of the front of the skateboard of FIG. 2 illustrating the steering axis angle while the suspension is uncompressed.
Figure 12A:
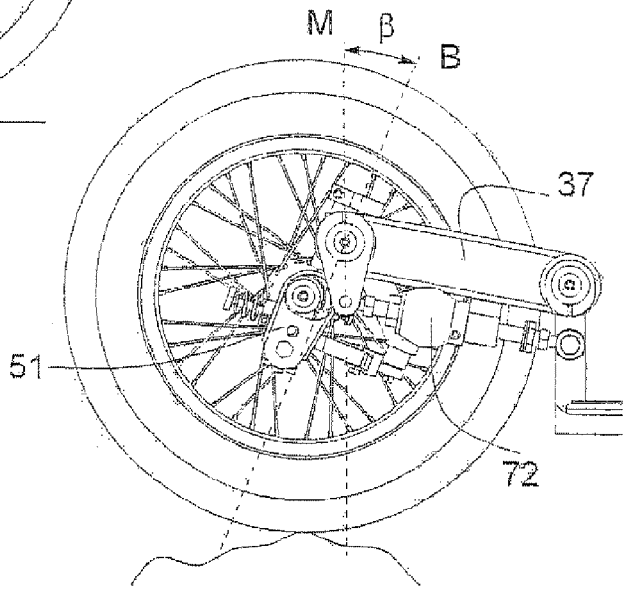
FIG. 12*a* is the view of the FIG. 12 illustrating the steering axis angle while the suspension is compressed.

The parallelogram consisting of front swing arm 37, bell crank clamp 50, tie rod/shock shaft 52 and generally upright frame tubes 10*d* enable the front wheel to move vertically without altering the steering axis B of the board. FIG. 12 illustrates the steering axis angle while the front shock absorber 72 of tie rod/shock shaft 52 is negligibly or only slightly compressed. Line M represents the vertical axis by which angle β is measured to locate the steering axis B. FIG. 12*a* illustrates the front wheel encountering a bump, and shows that the steering axis angle remains constant as the front shock absorber 72 is compressed. That is, although the swing arm has moved upwards, substantially the steering axis B remains at constant angle β with respect to vertical axis M. The steering axis angle remains consistent whether the suspension is compressed or not. This provides the rider with predictable and stable steering in all kinds of terrains.

Figure 11:
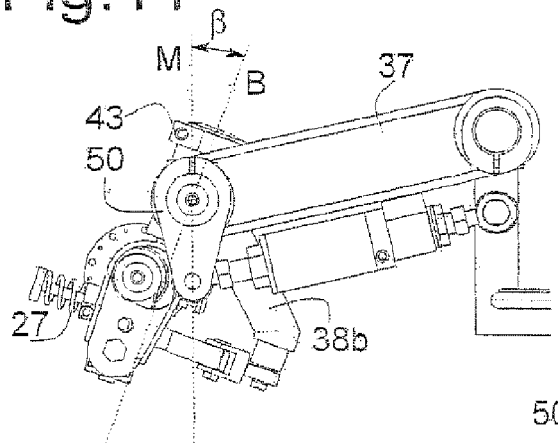
FIG. 11 is a left side view of front wheel illustrating the steering axis of the steering assembly.
Figure 11A:
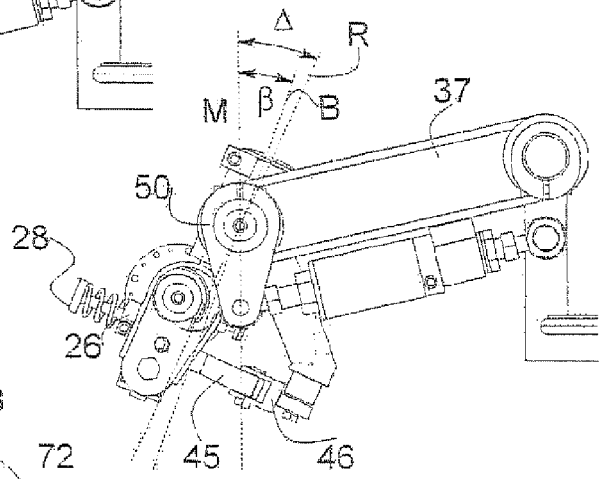

The angle of the steering axis determines the radius at which the board will be able to turn. FIGS. 11 and 11*a* illustrate how the steering axis angle can be adjusted by use of an alien key or wrench (not shown). In FIG. 11 the steering axis is represented as line B, the vertical axis is represented as line M and the angle at which the steering axis is in relation to the vertical axis is represented as β. FIG. 11*a* shows steering axis having been adjusted from that in FIG. 11. R represents the new steering axis angle and Δ represents the new angle at which the steering axis is located in reference to the vertical axis labelled M. In FIG. 11*a* Line B represents the original steering axis and β represents the original angle as found in FIG. 11.

Figure 16:
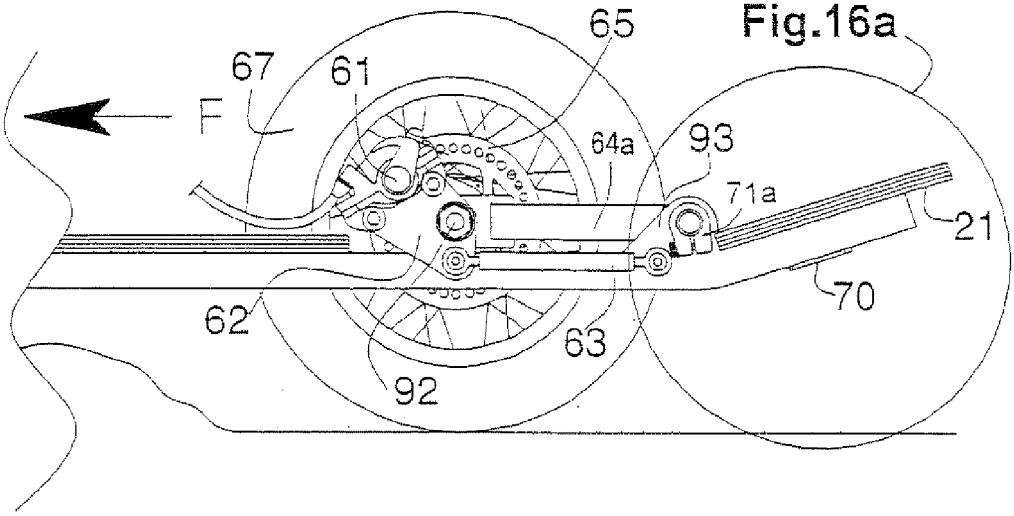
FIG. 16 is an enlarged left cut away view of the rear wheel, suspension swing arm and brake assembly.
Figure 16A:
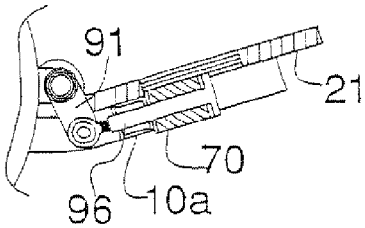
FIG. 16*a* is a partially cut-away view of FIG. 16 in vertical cross-section showing the swing arm pivot, tail platform and shock assembly.

In the single pivot embodiment of FIG. 16, two leading swing arms form forks 64 which surrounds the back half of the rear wheel. At the leading ends of the forks there are welded brackets which the rear wheel axle is fastened between. The two trailing ends of the swing arms are welded to a lateral tube which houses the pivot axle for the swing forks. The pivot of the swing forks is located just aft of the rear wheel and just prior to the rear standing platform. Nylon bushings which surround the swing axle are inserted at each end of the forks' pivot housing tube. The swing forks are pivotally mounted between two longitudinal frame brackets 93 which support each end of the lateral pivot axle. Aluminum clamps 71 at each end of the pivot axle secure the axle to the frame. The axle is constructed of relatively large diameter steel or aluminum tubing.

Two brackets 91 are mounted longitudinally to the bottom side of the lateral tube of the swing fork. A shock assembly including shock absorber 70 is pivotally mounted between the two brackets 91. The threaded male tie rod end is threaded to a female bolt 96. The female bolt 96 is journalled through apertures in a lateral frame member 10*a*, a polyurethane bushing 70, and a large washer at the head of the bolt.

When the rear wheel hits a bump the swing fork 64 rotates enabling the wheel to move upward. As the swing fork rotates the shock assembly bolt 96 is pulled in the direction of the rotation of the fork. Consequentially, the polyurethane bushing 70 is compressed between the large washer at the head of the female shock bolt 96 and the frame cross member 10*a*.

At the leading ends of the forks 64 are welded longitudinal brackets which the rear wheel axle 92 is fastened between. On the outside of at least one of the brackets, a brake mount 62 is pivotally fastened to the wheel axle. A caliper assembly 61 is bolted on the leading top portion of the brake mount. A pivoting tie rod 63 is bolted to the brake mount directly below the brake mount's axle pivot. The trailing rotatable rod end is attached to the frame below and in front of the swing fork's pivot. The tie rod assembly parallels the swing fork. The resulting parallelogram enables braking forces to be isolated from suspension forces. While the rear suspension is activated by bump forces the tie rod assembly allows the brakes to stop the wheel from rotating and control the point on the tire at which the tire makes contact with the ground.

Figure 14:
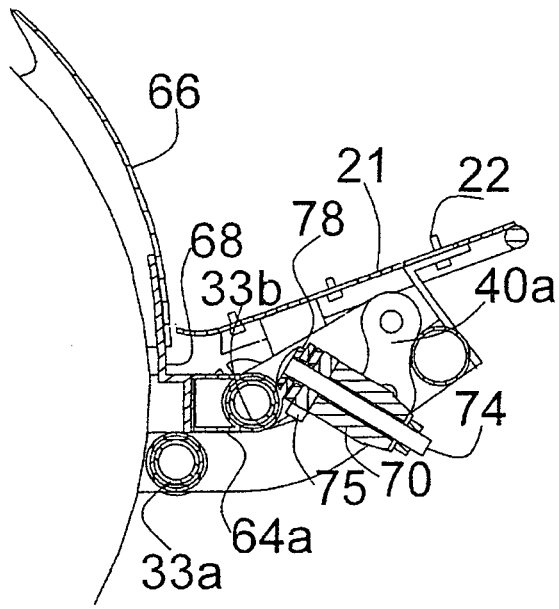
FIG. 14 illustrates a vertical cross section of the multi-pivot suspension.

In the multi-pivot embodiment FIG. 14 two leading swing arms form forks 64*a* which surround the back half of the rear wheel. At the leading ends of the forks there are welded brackets which the rear wheel axle is fastened between. The two trailing ends of the swing arms are welded to a lateral tube which houses the front pivot axle 33*b* for the swing forks. The forward pivot of the swing forks is located just aft of the rear wheel and just below the rear standing platform. Two rear members 64*b, c* are welded at perpendicular to the said lateral tube 64*d*, each rearward end of members 64*b* and 64*c* house the upper link lateral axes 40*a*' and 40*b*' of roller chain links 40*a* and 40*b* respectively.

Lateral cross member 10*e* houses the lower pivot axle 33*a*. Two rearward members 10*f* and 10*g* are welded at perpendicular to cross member 10*e*, the rearward end of member 10*f* and 10*g* house the lower link lateral axes 40*a*" and 40*b*" of roller chain links 40*a* and 40*b* respectively.

When the rear wheel hits a bump, the swing fork 64 rotates on links 32*a*, 32*b* and 40*a*, 40*b* enabling the wheel to move upward. As the swing fork rotates, the shock assembly is pulled by the forks movement in the direction of the forks. Consequently, the polyurethane bushing 70 is compressed between the large washer at the nut on the end of shock bolt 74. The shock compresses against crossbar 10*h* between rear members 10*f*. The flatbar 64*e* between rearward members 64*b* and 64*c* on the forks 64*a* pulls on bolt 74 when the forks move on links 32*a*, 32*b* and 40*a*, 40*b* as the rear wheel encounters a bump and translates upwards on the forks.

Aluminum clamps 32*a* and 32*b* are fastened at each end of pivot axles 33*a* and 33*b* forming unitary link between lateral housing tube 64*d* on fork 64*a* and lateral tube 10*e* on frame 10.

Figure 13:
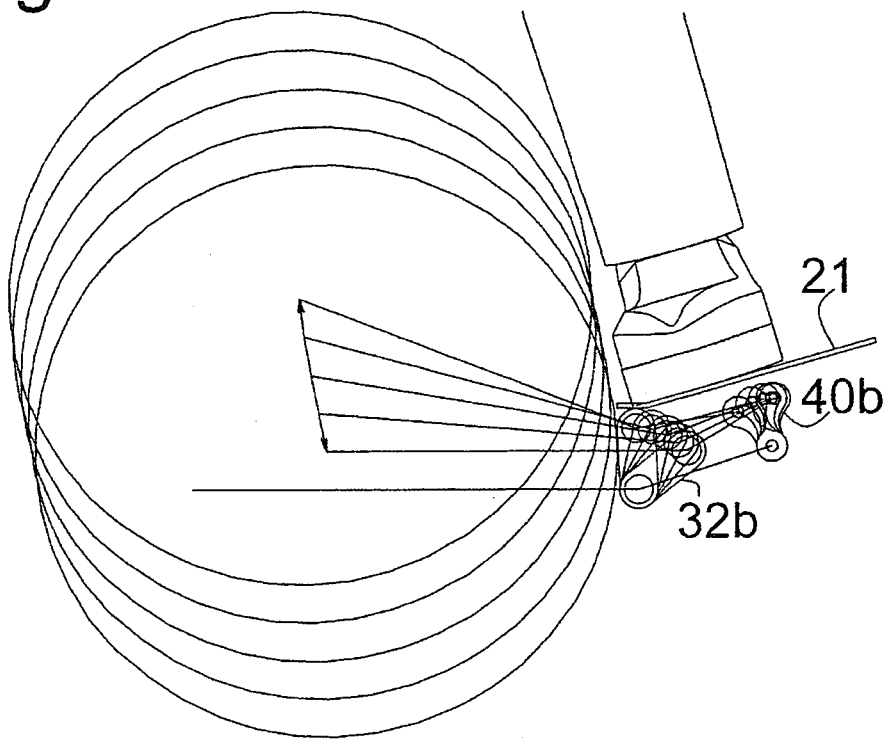
FIG. 13 illustrates the range of rear wheel motion as the rear wheel travels vertically.
Figure 18:
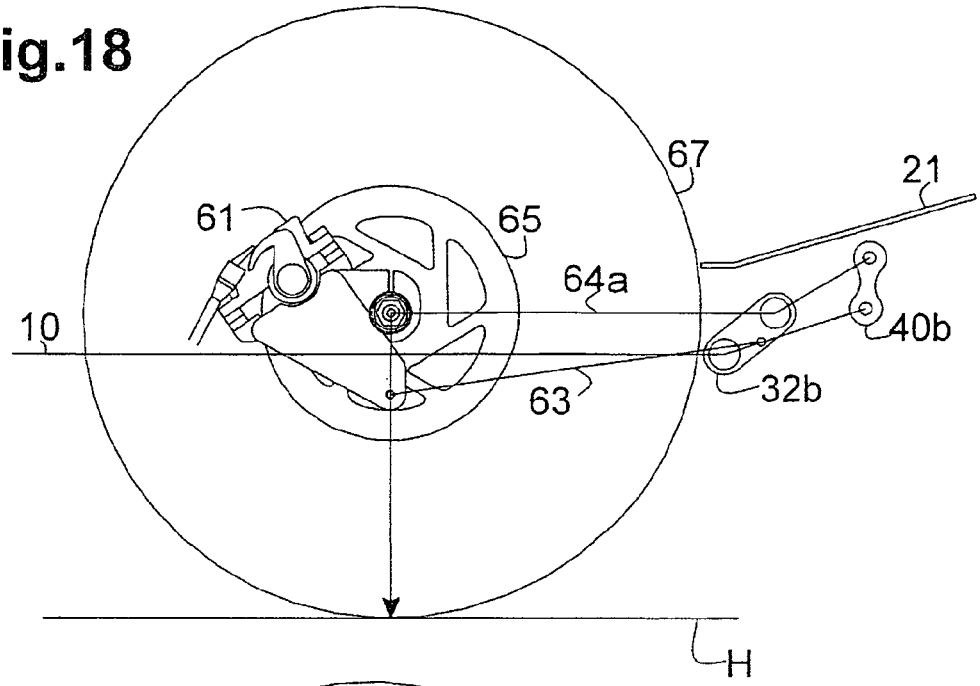
FIGS. 18 and 18*a* are diagrammatic views of the range of motion of the floating brake system showing the side of the rear wheel and brake system while the suspension is uncompressed.
Figure 18A:
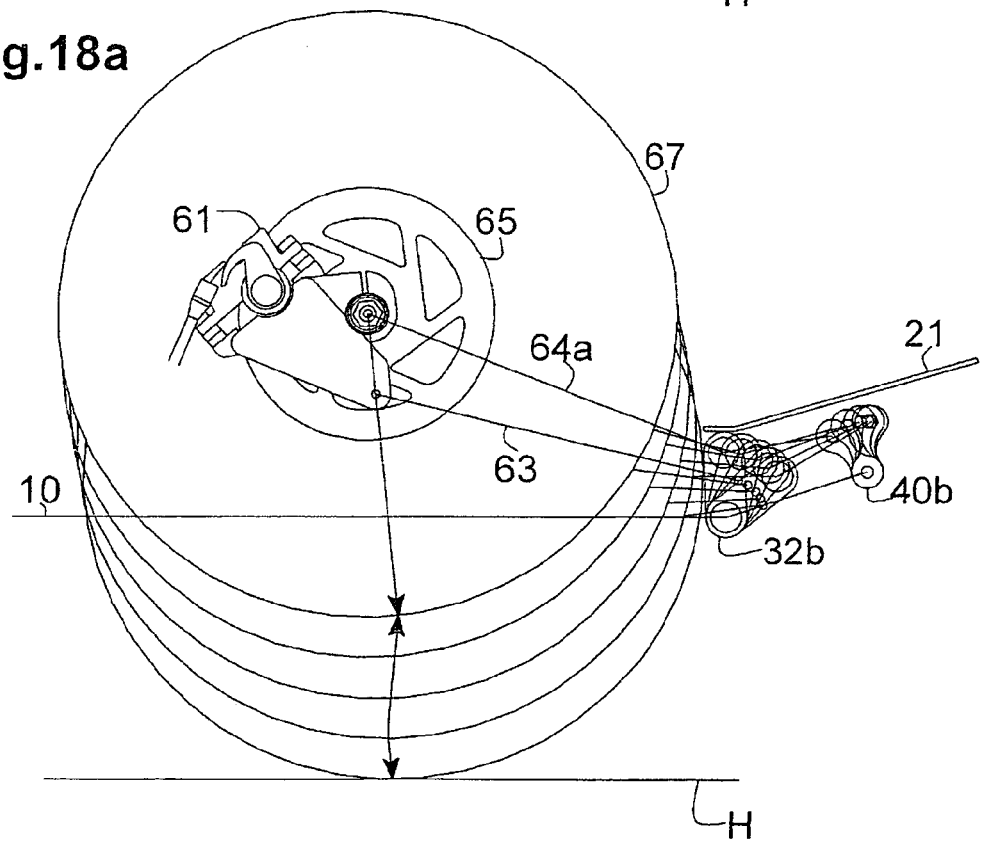

FIGS. 13 and 18*a* illustrate the path that the wheel takes in its suspension travel. The point of the multi-pivot rear suspension is to allow for long wheel travel without the problem of the wheel hitting the leg/foot of the rider. A rider's foot and leg is illustrated standing on the rear platform. The single pivot rear suspension, also seen in FIG. 16 is relatively light and simple, and the wheel path works well to absorb impact as the path is upward and rearward. However, the suspension should only be used for either small wheeled boards or short travel boards, otherwise the rear wheel is directed into the rider's leg. The advantage to having a pivot behind the rear wheel is that it decreases stress on the main frame. To have the pivot in front of the rear wheel places leverage on the tail of the board. This would require extra reinforced frame and stiffer shock absorbers.

Parts List

Part 10 main frame constructed out of steel or aluminum tubing

Part 10*a* rear lateral frame member which is pierced to accommodate rear shock shaft through. The polyurethane plastic shock 70 of the single pivot rear suspension is sandwiched between this frame member and the nut and washer at the trailing end of the shock shaft.

Part 10*b* the uppermost frame member. It is situated laterally and acts as the main pivot axle of the front swing arm 37.

Part 10*c* The frame mount for the tie rod/front shock 52. A bolt sandwiches the spherical bearing of the trailing end of the shock/tie rod assembly and threads into the frame mount.

Part 10*d* vertical supports for frame member 10*b*.

Part 10*e* rear cross tube of frame 10

Part 10*f* rearward member of frame 10

Part 10*g* rearward member of frame 10

Part 18 Tire. Without intending to be limiting the tires are 14 inch dirt bike tires.

Part 20 front standing platform. Constructed out of thin sheet aluminum to allow for lower center of gravity. The lateral edges of deck are welded to aluminum tubing or round stock to provide rigid, safe and smooth edges. Holes are cut to lighten deck. Screws 22 are threaded upward from the underside to provide for traction.

Part 21 rear standing platform. Constructed the same as front platform. The leading edge of platform can be bent upward to allow the rear suspension to move wheel through full range of travel. All outside edges are welded to round aluminum tubing or round stock. Screws are also utilized to add tractions. (the illustration for the single pivot board shows a wooden deck.)

Part 22 small screw that is threaded from bottom side of aluminum deck so that head of screw is tightened against underside of board. Screw acts like stud for traction. It is necessary because in wet conditions skateboard grip tape (sand paper) fills up with mud and become ineffective.

Part 23 the rocker link shell 23 pivots within rocker housing 51. It is made of steel or aluminum sheet metal. It is fashioned to conform to the outer profile of the wheel axle (41) as it is resting in the axle saddle of the rocker. Two alien bolts (24*a, b*) are threaded into the bottom of the rocker shell. When the bolts are tightened they push against the bottom of the rocker (58). This clamps the axle between the rocker shell and the rocker.

Part 23*a* window in rocker link shell 23.

Part 24*a, b* all bolts which when tightened clamp the rocker, rocker shell and wheel axle together.

Part 25 steering damper shaft. It is basically a T shaped bolt. It pierces through the rocker shell and the rocker housing (51). The face of the head of the bolt rests against the inside of the rocker shell. The T shape allows the bolt to pivot within the rocker shell.

Part 26 Steering damper rebound adjuster. This is a nylon clamp the surrounds the damper shaft. A small screw is used to adjust the tension on the clamp. It adds friction to the movement of the shaft. It enables the rider to control the speed at which the damper spring will rebound.

Part 27 Steel steering damper spring.

Part 28 Threaded damper cap. It sandwiches the spring, rebound adjuster, yolk and rocker shell/rocker assembly between the head of the damper shaft.

Part 29 Set screw and lock nut. The set screw and lock nut restricted the range at which the axle rocker (58) can rock backwards/downward. The point of restricting the range of rock is to restrict the range at which the wheel can turn away from straight ahead alignment so that the wheel will not rub the side of the swing arm.

Part 30*a* This is a star nut that is pressed into the end of the front wheel axle. When pressed into the axle it resists the urge to ever come out.

Part 30*b* This is the cap/screw that threads into the star nut situated in the wheel axle. when the cap/screw is tightened it pulls the wheel axle into the rocker shell and saddle. This is not intended to fix the front wheel to the board, it just ensures that everything is snug when the rocker shell bolts are tightened.

Part 31 spacer sleeve. It distributed the gravitational forces evenly between both upper and lower bearings.

Part 32*a, b* Aluminum links/clamps for rear suspension. Fastens the main two large diameter axles together in a unified and stiff manner.

Part 33*a, b* large diameter steel axle tubes.

Part 35*a*-35*e* Threadless bicycle headset comprised of: a star nut (35*a*) pressed into the upper most lateral frame tube (10*b*), bearing (35*b,c*) that internal diameter is pressed onto later frame tube (10*b*) and external diameter is pressed into the trailing end (37*b*) of the front swing arm. An externally tapered nylon ring 35*d* which wedges between the tapered I.D. of the bearings 35*c* and the frame tube 10*b*. The cap/screw assembly 35*e* is threaded into the star nut and pulls clamp (73) the bearings and the swing arm together.

Part 36*a*-36*e* Threadless bicycle headset comprised of: a star nut (36*a*) pressed into the lateral tube (38*a*), bearing (36*b*, 36*c*) that internal diameter is pressed onto lateral tube (38*a*) and external diameter is pressed into the leading end (37*a*) of the front swing arm. An externally tapered nylon ring 36*d* which wedges between the tapered I.D. of the bearings 36*c* and the lateral tube 38*a*. The cap/screw assembly 36*e* is threaded into the star nut and pulls clamp (50) the bearings and the swing arm together.

Part 37 the front swing arm constructed out of aluminum tubing. The front tube portion (37*a*) pivotally houses the steering head tube lateral axle (38*a*). The rear tube portion (37*b*) pivotally houses the lateral frame tube (10*b*) on the underside of a bracket (37*c*) which the shock shaft/tie rod (52) pierces. The shock shaft/tie rod is free to float within this bracket as the swing arm is moved through the suspension travel. The bracket is the point where the shock is mounted on the swing arm, so it acts to compress the shock.

Part 38 the steering column head tube. It houses the bearings (44*b* and 44*c*) and the steering tube 51*a*. Lateral tube 38*a* forms the axle tube for the front swing arm (37). Lower tube 38*b* provides the anchor mount for the swing link 46.

Part 39 The front wheel assembly

Part 40*a,b* Pairs of roller chain links having transverse axles (40*a'*, 40*a"*, 40*b'*, 40*b"*) between the pairs of links Part 41 large diameter axle. Constructed of steel or aluminum. Flanged at one end.

Part 42 tie rod assembly mounted between strut 38*b*. swing linkage assembly of swing link 46 and trailing arm 45.

Part 43 aluminum clamp to secure the steering bearing assembly.

Part 44 steering bearing assembly comprised of cap/screw assembly 44*a*, top sealed bearing 44*b* which is pressed into the top of the head tube 38, bottom sealed bearing 44*c* which is pressed into the bottom of the head tube, and star nut 44*d* which is pressed into the steering tube 51*a*.

Part 45 trailing arm which pivots on a lateral axis (bolt 47) at the rocker end. It is fashioned out of aluminum or steel.

Part 46 swing link. Trailing end is pivotally mounted to the longitudinal axis of the board by the steering tube member 38*b*. It is comprised of a spherical bearing at the trailing end and clevis at leading end.

Part 46*a* is the mounting pivot bolt for swing link 46.

Part 46*b* is the bolt that serves as the vertical axis of rotation of the front portion of the swing link 46 and of the rear portion of trailing arm 45.

Part 47 allen bolt which pivotally sandwiches trailing arm 45 between the two upright members of rocker link (58).

Part 48*a,b* sealed rocker bearing pressed into rocker link (58)

Part 48*c* bolt on which the rocker link 58 pivots

Part 50 Aluminum bellcrank clamp which fastens the steering column head tube assembly (38) pivotally into the awing arm assembly (37). It also serves as a link which connects the head tube assembly via the shock shaft to the frame. The resulting parallelogram enables the front suspension to move through its full range of travel without altering the steering angle.

Part 51 The rocker housing. It is constructed from steel tubing for the steering tube (51*a*) portion and steel flatbar shaped into a configuration which houses the wheel axle rocker link (58). The two portions, 51 and 51*a* are welded together.

Part 51*a* Steering tube mounted to rocker housing 51.

Part 51*b* The opening or window in the rear wall.

Part 52 tie rod/shock shaft. Comprised of aluminum or steel tube that is threaded externally and internally on both ends. The internal threads at both ends accept spherical end bearings. The external threads accept large nuts. A nylon rebound adjuster (57) surrounds the tie rod and butts up against the swing arm bracket 37*c*. In front of the rebound adjuster is a thick walled polyurethane tube (72) which also surrounds the rod. At the heading end is a large nut and washer which compresses the polyurethane and rebound adjuster against the swing arm bracket. On the trailing end of the swing arm bracket is a smaller polyurethane bushing which acts as a stop so that the swing arm does not flop around when the board is unweighted. A large nut and washer at the furthermost trailing end secure the bushing in place.

Part 38*b* rigid strut depending downwardly from steering head tube 38. The tie rod assembly 42 is mounted to the lower end of the strut.

Part 56 rocker link, includes cradle 58 and shell 23

Part 57 nylon clamp that surrounds the tie rod/shock shaft.

Part 58 The rocker cradle. It is machined out of billet aluminum. Fits into shell 23 to form ½ of rocker link 56.

Part 61 disc brake callipers.

Part 62*a* floating caliper mount. Machined from aluminum. Pivots on the rear wheel axle. Rotates on two sealed bearing placed beside eachother. The bearings are clamp in place within the caliper mount.

Part 62*b* The face plate is shaped out of sheet aluminum and bolted onto the caliper mount.

Part 63 The tie rod which connects the floating caliper mount to rear suspension link 32*b*. It is made the aluminum tubing or round stock that is drilled and tapered to accommodate bearing ends.

Part 64 rear swing forks of the, single pivot rear suspension. Constructed of steel or aluminum tubing.

Part 64*a* the rear swing forks of the multi-pivot rear suspension. Constructed of steel or aluminum tubing.

Part 65 mountain bike disc portion of the disc brake assembly.

Part 66 plastic fender mounted to the swing fork by aluminum bracket (68)

Part 67 rear tire

Part 68 aluminum fender mounting bracket which is screwed to the lateral member of the rear forks and bolted to the fender.

Part 70 polyurethane bushings which act as the shock absorber for the rear suspension Part 71 clamp which hold pivot axle in place on single pivot board.

Part 72 polyurethane tube which surrounds shock shaft/tie rod (52) and acts as shock absorber for the front swing arm (37)

Part 73 aluminum clamp at the end of 10*b*. It keeps the bearing assembly together.

Part 74 a long bolt which serves as the shock shaft.

Part 75 Shock rebound adjuster—nylon clamp that is tightened with a set screw. Creates friction to slow the rebound of the shock.

Part 78 polyurethane busing that allows the head of bolt 74 to float.

Part 80 Rim of front wheel. A wide rim that has flange (80*a*) on one side. Wire spokes (82) are laced to the flange. The rim could be made from steel or aluminum. Because there is no need for spoke holes inside the rim tires could be mounted tubeless.

Part 82 wire spokes

Part 83 front hub. Machined from aluminum and built to fashion a strong large diameter axle (41)

Part 90 spoke nipple

Part 91 shock assembly mounting brackets

Part 92 rear wheel axle

Part 93 longitudinal frame brackets for rear suspension swing forks.

Part 94*a*-94*d* nylon bushings which the main pivot axle (for single pivot) or axles (33*a,b*) rotate on. They are pressed into the lateral frame and fork members which house the main pivots. The bushings are flanged on the outside end to allow for some side load.

Part 95 the eight nylon bushings which the trailing rear suspension links rotate on. They are pressed into the lateral frame and fork mounts which house the axis of the pivots.

Part 96 female bolt of rear shock assembly

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An in-line, off-road skateboard comprising:

a substantially planar frame having opposite forward and aft ends, said frame having a longitudinally extending centroidal axis, a front wheel supported on said forward end, and a rear wheel supported on said aft end, said front and rear wheels lying in a common plane when said front wheel is in a straight-ahead alignment, said common plane intersecting said centroidal axis and orthogonal to said frame so as to be vertical when said frame is horizontal, said front wheel including a front rim mounted within a front tire wherein said front rim defines a front rim cavity therein, and wherein said front and rear wheels have corresponding laterally aligned front and rear axes of rotation respectively, said front and rear axes of rotation parallel when said front wheel is in said straight-ahead alignment, said front rim cavity having an opening corresponding to said front axis of rotation, said frame including a rigid platform between said front and rear wheels, a front arm mounted on said forward end of said frame, said front arm having opposite front and rear ends, said rear end of front arm said mounted to said forward end of said frame, and wherein said front end of said front arm is positioned adjacent said opening into said front rim cavity of said front wheel, a steering assembly mounted substantially within said front rim cavity, said steering assembly including a steering column aligned along a steering axis of rotation of said front wheel, a rocker link pivotally mounted at a first end thereof to said steering column for pivoting of said rocker link about a rocker link pivot axis parallel to said front axis of rotation and perpendicular to said steering axis of rotation, a front wheel axle and hub mounted to a second end of said rocker link opposite to said first end of said rocker link, said front wheel axle and hub aligned along said front axis of rotation, said front rim mounted to said front wheel axle and hub for rotation of said front wheel about said front axis of rotation, wherein said first end of said rocker link and said rocker link pivot axis are below said second end of said rocker link, a trail adjusting linkage assembly mounted at a first end thereof to said rocker link and mounted at a second end thereof to said steering column, wherein said steering axis of rotation and said steering column are inclined, and wherein a trail distance of said steering assembly, wherein a first intersection of a vertical axis through said front axis of rotation with a ground plane under and contacting said front and rear wheels is aft of a second intersection of said steering axis with said ground plane, is the distance in said ground plane between said first and second intersections, and wherein, as said front wheel rotates about said steering axis and out of said straight-ahead alignment with said centroidal axis of said frame, a trail adjusting linkage of said trail adjusting linkage assembly progressively pivots said second end of said rocker link towards said steering axis of rotation so as to progressively increase said trail distance and progressively elevate said frame away from said ground plane as said front wheel correspondingly progressively rotates further out of said straight-ahead alignment with said centroidal axis of said frame, and so as to progressively decrease said trail distance and progressively lower said frame closer to said ground plane as said front wheel correspondingly progressively returns to said straight-ahead alignment with said centroidal axis of said frame, wherein during forward translation of said skateboard as a rider standing on said skateboard leans into a turn and thereby tilts said frame about said centroidal axis so as to tilt said frame into the turn, said front wheel precesses into the turn about said steering axis of rotation thereby increasing said trail distance whereby the greater the tilt the greater the progressive turning of said front wheel about said steering axis of rotation within a range of motion of said front wheel, and conversely as the rider leans out of a turn and thereby tilts said frame about said centroidal axis so as to tilt said frame out of the turn, said front wheel precesses out of the turn about said steering axis of rotation thereby decreasing said trail distance and gravitational force assists said front wheel to return to straight-ahead wheel alignment as gravity urges said frame and the rider to settle into a position which corresponds to said straight ahead wheel alignment.

2. The skateboard of claim 1 wherein said front arm is a front suspension swing arm pivotally mounted on said forward end of said frame, and wherein, a front suspension dampener cooperates between said front suspension swing arm and said forward end of said frame to resiliently dampen upward pivoting, of said swing arm.

3. The skateboard of claim 1 wherein said rear wheel is mounted on a rear suspension swing arm assembly pivotally mounted to said aft end of said frame, said skateboard further comprising a rear platform on said aft end of said frame and aft of said rear wheel, and wherein said rear suspension swing arm assembly includes a resilient dampener cooperating with at least one rear suspension swing arm to resiliently dampen upward pivoting of said at least one rear suspensions swing arm.

4. The skateboard of claim 2 further comprising a parallelogram linkage cooperating between said steering column and said front end of said frame, wherein said front suspension dampener forms part of said parallelogram linkage.

5. The skateboard of claim 1 further comprising a rocker housing and wherein said rocker link is pivotally mounted for said pivoting about said rocker link pivot axis within said housing.

6. The skateboard of claim 5 wherein a steering dampener is mounted to said housing so as to act on said rocker link, wherein said pivoting of said rocker link is resiliently dampened, so that said steering dampener acts to dampen a return pivoting of said rocker link pivoting said second end of said rocker link away from said steering axis of rotation.

7. The skateboard of claim 6 wherein said rocker link supports said front wheel axle, and wherein an upper end of said housing is mounted to a lower end of said steering column.

8. An inline, off-road skateboard comprising of a substantially planar frame having opposite forward and aft ends, said frame having a longitudinally extending centroidal axis, a front wheel supported on said forward end, and a rear wheel supported on said aft end, said front and rear wheels lying in a common plane when said front wheel is in a straight-ahead alignment, said common plane intersecting said centroidal axis and orthogonal to said frame so as to be vertical when said frame is horizontal, said front wheel including a front rim mounted nested within a front tire wherein said front rim defines a front rim cavity therein, and wherein said front and rear wheels have corresponding, laterally aligned front and rear axes of rotation respectively, said front and rear axes of rotation parallel when said front wheel is in said straight-ahead alignment, said front rim cavity having an opening into said front rim cavity corresponding to said front axis of rotation, said frame including a rigid platform between said front and rear wheels, a front arm mounted on said forward end of said frame, said front arm having opposite front and rear ends, said rear end of said front arm said mounted to said forward end of said frame, and wherein said front end of said front arm is positioned adjacent said opening into said front rim cavity of said front wheel, a steering assembly mounted substantially within said front rim cavity, said steering assembly including a steering column aliened along a steering axis of rotation of said front wheel, a rocker link pivotally mounted at a first end thereof to said steering column for pivoting of said rocker link about a rocker link pivot axis parallel to said front axis of rotation and perpendicular to said steering axis of rotation, a front wheel axle and hub mounted to a second end of said rocker link opposite to said first end of said rocker link, said front wheel axle and hub aligned along said front axis of rotation, said front rim mounted to said front wheel axle and hub for rotation of said front wheel about said front axis of rotation, a trail adjusting linkage assembly mounted at a first end thereof to said rocker link and mounted at a second end thereof to said steering column, wherein said steering axis of rotation and said steering column are inclined, and wherein a trail distance of said steering assembly, wherein a first intersection of a vertical axis through said front axis of rotation with a ground plane under and contacting said front and rear wheels is aft of a second intersection of said steering axis with said ground plane is the distance in said around plane between said first and second intersections, and wherein, as said front wheel rotates about said steering axis and out of said straight-ahead alignment with said centroidal axis of said frame, a trail adjusting linkage of said trail adjusting linkage assembly progressively pivots said second end of said rocker link towards said steering axis of rotation so as to progressively increase said trail distance and progressively elevate said frame away from said ground plane as said front wheel correspondingly progressively rotates further out of said straight-ahead alignment with said centroidal axis of said frame, so as to progressively decrease said trail distance and progressively lower said frame closer to said ground plane as said front wheel correspondingly progressively returns to said straight-ahead alignment with said centroidal axis of said frame, wherein during forward translation of said skateboard as a rider standing on said skateboard leans into a turn and thereby tilts said frame about said centroidal axis so as to tilt said frame into the turn, said front wheel processes into the turn about said steering axis of rotation thereby increasing said trail distance whereby the greater the tilt the greater the progressive turning of said front wheel about said steering axis of rotation within a range of motion of said front wheel, and conversely as the rider leans out of a turn and thereby tilts said frame about said centroidal axis so as to tilt said frame out of the turn, said front wheel precesses out of the turn about said steering axis of rotation thereby decreasing said trail distance and gravitational force assists said front wheel to return to straight-ahead wheel alignment as gravity urges the said frame and the rider to settle into a position which corresponds to said straight ahead wheel alignment, wherein a rear platform is mounted behind said rear wheel and wherein said rear wheel is pivotally mounted to said rear end of said frame on a rear suspension swing arm so that said rear wheel has a vertical range of motion corresponding to a vertical range of pivoting motion of said rear suspension swing arm, and wherein said rear suspension swing arm pivots about a rear end thereof, and said rear end of said rear suspension swing arm is adjacent a forward end of said rear platform, wherein an upper limit of said rear wheel range of motion and said range of pivoting motion are constrained by a resilient dampener, and whereby said upper limit inhibits contact between said rear wheel and a leg of a user when a user's leg is standing on said rear platform.

9. The skateboard of claim 8 wherein said resilient dampener cooperates with said rear suspension swing arm and is mounted under said rear platform so that said resilient dampener is resiliently compressed by upward pivoting of said rear suspension swing arm.

10. The skateboard of claim 1 wherein said trail adjusting linkage assembly further includes a rigid member depending rigidly downwardly from said steering column, and wherein said trail adjusting linkage is pivotally mounted at a front end thereof to said rocker link and at a rear end thereof to a lower end of said rigid member, wherein said trail adjusting linkage is substantially linear, and wherein said trail adjusting linkage assembly further includes a trail adjusting bell-crank cantilevered rearwardly from said rocker link, a distal end of said trail adjusting bell-crank distal from said rocker link said pivotally mounted to said front end of said trail adjusting linkage.

11. The skateboard of claim 8 wherein said trail adjusting linkage assembly further includes a rigid member depending rigidly downwardly from said steering column, and wherein said trail adjusting linkage is pivotally mounted at a front end thereof to said rocker link and at a rear end thereof to a lower end of said rigid member, wherein said trail adjusting linkage is substantially linear, and wherein said trail adjusting linkage assembly further includes a trail adjusting bell-crank cantilevered rearwardly from said rocker link, a distal end of said trail adjusting bell-crank distal from said rocker link said pivotally mounted to said front end of said trail adjusting linkage.

12. The skateboard of claim 8 wherein said forward end of said frame includes at least one upright extending upwardly from said platform and wherein said rear end of said front arm is mounted to an upper end of said at least one upright.

* * * * *